US007238236B2

(12) United States Patent
Wilks et al.

(10) Patent No.: US 7,238,236 B2
(45) Date of Patent: Jul. 3, 2007

(54) APPARATUS FOR INCREASING TAIL ADHESION OF WET ROLLS

(75) Inventors: David J. Wilks, Appleton, WI (US); Andrew Peter Doyle, Martinez, GA (US); Kenneth Y. Wang, Alpharetta, GA (US); Duane K. Zacharias, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 539 days.

(21) Appl. No.: 10/295,013

(22) Filed: Nov. 14, 2002

(65) Prior Publication Data

US 2004/0096483 A1 May 20, 2004

(51) Int. Cl.
*B05C 3/12* (2006.01)
*B05C 11/02* (2006.01)
*B65H 81/00* (2006.01)

(52) U.S. Cl. ..... 118/325; 118/117; 118/420; 156/578; 156/446; 156/450

(58) Field of Classification Search ..... 118/325, 118/117, 420, 300, 313–316; 156/502, 504, 156/505, 578, 446–450; 162/109–111, 118–121; 424/443

See application file for complete search history.

(56) References Cited

U.S. PATENT DOCUMENTS 3,172,612 A 3/1965 Besserdich
3,856,226 A 12/1974 Dowd, Jr.
3,898,920 A 8/1975 Zucker
3,926,299 A 12/1975 Bradley et al.
3,935,057 A 1/1976 Gray
4,026,752 A * 5/1977 Hartbauer et al. ..... 156/457
4,100,324 A 7/1978 Anderson et al.
4,280,669 A 7/1981 Leanna et al.
4,487,377 A 12/1984 Perini
4,495,011 A * 1/1985 Scharfenberg et al. ..... 156/78
4,635,867 A * 1/1987 Kytonen ..... 242/527.2
4,741,944 A * 5/1988 Jackson et al. ..... 428/152
4,775,110 A * 10/1988 Welp et al. ..... 242/521
4,818,464 A 4/1989 Lau
4,842,681 A * 6/1989 Bader et al. ..... 156/504
4,856,725 A 8/1989 Bradley
4,894,277 A * 1/1990 Akasaki ..... 428/198
5,125,302 A 6/1992 Biagiotti
5,137,225 A 8/1992 Biagiotti
5,248,106 A 9/1993 Biagiotti
5,259,910 A * 11/1993 Biagiotti ..... 156/456
5,271,137 A 12/1993 Schutz
5,271,515 A 12/1993 Berkheimer et al.

(Continued)

FOREIGN PATENT DOCUMENTS

GB 1009687 11/1965

(Continued)

*Primary Examiner*—Yewebdar Tadesse
(74) *Attorney, Agent, or Firm*—Brinks Hofer Gilson & Lione

(57) ABSTRACT

An apparatus for making a wet roll including a body of a roll of wet wound sheet material, where the body of the roll is connected to a tail of the roll, means for applying an adhesion promoter between the body and the tail and means for contacting the body and the tail. The body and tail of the roll contain a wetting solution.

45 Claims, 12 Drawing Sheets

U.S. PATENT DOCUMENTS

| | | | | |
|---|---|---|---|---|
| 5,368,252 | A | 11/1994 | Biagiotti | |
| 5,387,284 | A | 2/1995 | Moody | |
| 5,402,960 | A | 4/1995 | Oliver et al. | |
| 5,538,199 | A | 7/1996 | Biagiotti | |
| 5,542,622 | A | 8/1996 | Biagiotti | |
| 5,603,467 | A | 2/1997 | Perini et al. | |
| 5,636,810 | A * | 6/1997 | Dorfel et al. | 242/530.4 |
| 5,839,680 | A | 11/1998 | Biagiotti | |
| 5,979,818 | A | 11/1999 | Perini et al. | |
| 6,022,452 | A | 2/2000 | Caspar | |
| 6,028,018 | A * | 2/2000 | Amundson et al. | 442/381 |
| 6,129,304 | A | 10/2000 | Biagiotti | |
| 6,257,410 | B1 | 7/2001 | Ulmann et al. | |
| 6,342,297 | B1 | 1/2002 | LaBrash | |
| 6,372,064 | B1 * | 4/2002 | Butterworth et al. | 156/64 |
| 6,423,804 | B1 | 7/2002 | Chang et al. | |
| 6,429,261 | B1 | 8/2002 | Lang et al. | |
| 6,444,214 | B1 | 9/2002 | Cole et al. | |
| 6,537,631 | B1 | 3/2003 | Rivera et al. | |
| 6,537,663 | B1 | 3/2003 | Chang et al. | |
| 6,548,592 | B1 | 4/2003 | Lang et al. | |
| 6,579,570 | B1 | 6/2003 | Lang et al. | |
| 2002/0127937 | A1 | 9/2002 | Lange et al. | |
| 2003/0015209 | A1 | 1/2003 | Gingras et al. | |
| 2003/0017333 | A1 | 1/2003 | Hoo et al. | |
| 2003/0025029 | A1 | 2/2003 | Gingras et al. | |
| 2003/0113458 | A1 | 6/2003 | Hoo et al. | |
| 2006/0124247 | A1 * | 6/2006 | Collins et al. | 156/446 |

FOREIGN PATENT DOCUMENTS

| | | |
|---|---|---|
| WO | WO 00/63099 | 10/2000 |
| WO | WO 01/40090 A2 * | 6/2001 |

* cited by examiner

APPARATUS FOR INCREASING TAIL ADHESION OF WET ROLLS

BACKGROUND

Wet products such as wet wipes have many applications. They may be used with small children and infants when changing diapers, they may be used for house hold cleaning tasks, they may be used for cleaning hands, they may be used as a bath tissue, they may be used as by a caregiver to clean a disabled or incontinent adult, or they may be used in and for a whole host of other applications, where it is advantageous to have a wipe or towel that has some moisture in it.

Wet wipes have traditionally been made in processes in which larger webs of wipes are initially made and than these larger webs are converted into smaller rolls or sheets that can be placed in a dispenser. Embodiments of dispensers are described in copending applications Ser. No. 09/545,995 filed Apr. 10, 2000; Ser. No. 09/565,227 filed May 4, 2000; Ser. Nos. 09/659,307; 09/659,295; 09/660,049; 09/659,311; 09/660,040; 09/659,283; 09/659,284 and 09/659,306, filed Sep. 12, 2000; Ser. No. 09/748,618, filed Dec. 22, 2000; Ser. No. 09/841,323, filed Apr. 24, 2001; Ser. No. 09/844,731, filed Apr. 27, 2001; and Ser. No. 09/849,935, filed May 4, 2001, all of which are commonly assigned to Kimberly-Clark, and the disclosures of which are incorporated herein by reference.

Wet wipes can be any wipe, towel, tissue or sheet like product including natural fibers, synthetic fibers, synthetic material and combinations thereof, that is wet or moist. Examples of wet wipes are disclosed in U.S. Pat. Nos. 6,423,804 B1; 6,429,261 B1; 6,444,214 B1; and in copending U.S. patent applications Ser. Nos. 09/564,449; 09/565,125; 09/564,837; 09/564,531; 09/564,268; 09/564,424; 09/564,780; 09/564,212; 09/565,623 all filed May 4, 2000; and Ser. No. 09/900,698, filed Jul. 6, 2001. All of these patents and patent applications are commonly assigned to Kimberly-Clark, and the disclosures of all these documents are incorporated herein by reference.

There is a need for improved methods for making wet wipes, particularly for making rolls of wet wipes. Typically, wet wipes are manufactured as a roll of dry sheets and are then soaked in a wetting solution. Among other disadvantages, this method can lead to undesirable variations in the properties and performance of the wipes. It is desirable to manufacture wet wipes such that the wetting solution and its ingredients are uniformly distributed throughout the web material as well as the final product. Insufficient adhesion between the tail and the rest of the wet roll can lead to difficulties in the manufacture of wet wipes. It is thus desirable to increase the adhesion of the tail of a roll of wet wipes during the roll production process while maintaining the uniform distribution of ingredients.

BRIEF SUMMARY

In an embodiment of the invention there is provided a method of making a wet roll, comprising providing a body of a roll of wet wound sheet material, the body connected to a tail of the roll, and the body and tail comprising a first wetting solution; applying an adhesion promoter between the body and the tail; and contacting the body and the tail.

In an embodiment of the invention there is provided a method of making a wet roll, comprising applying an aqueous foam to a roll of wet wound sheet material, the roll comprising a body and a tail pendant to the body; and contacting the tail to the body.

In an embodiment of the invention there is provided an apparatus for making wet rolls, comprising means for applying an adhesion promoter to a roll of wet wound sheet material, the roll comprising a body and a tail pendant to the body; and means for contacting the tail to the body.

In an embodiment of the invention there is provided an apparatus for making wet rolls, comprising a surface positioned to accept a roll of wet wound sheet material, the roll comprising a body and a tail pendant to the body; and a solution applicator configured to contact the roll with a wetting solution once the roll is on the surface.

In an embodiment of the invention there is provided a method of making a plurality of wet rolls, comprising providing a roll of wet wound sheet material, the roll comprising a body, and a tail connected to the body; applying an adhesion promoter to the roll when the roll is at an application site to produce a treated roll; transporting the treated roll away from the application site; and repeating the providing, applying and transporting.

DETAILED DESCRIPTION

A method for increasing tail adhesion of wet rolls is provided which in general includes applying an adhesion promoter between the tail of a wet roll and the body of the wet roll. The method may provide for a reduction in the frequency of production of wet rolls having loose tails. The method may also provide for a uniform distribution of ingredients in products made from the wet rolls.

Figure 1:
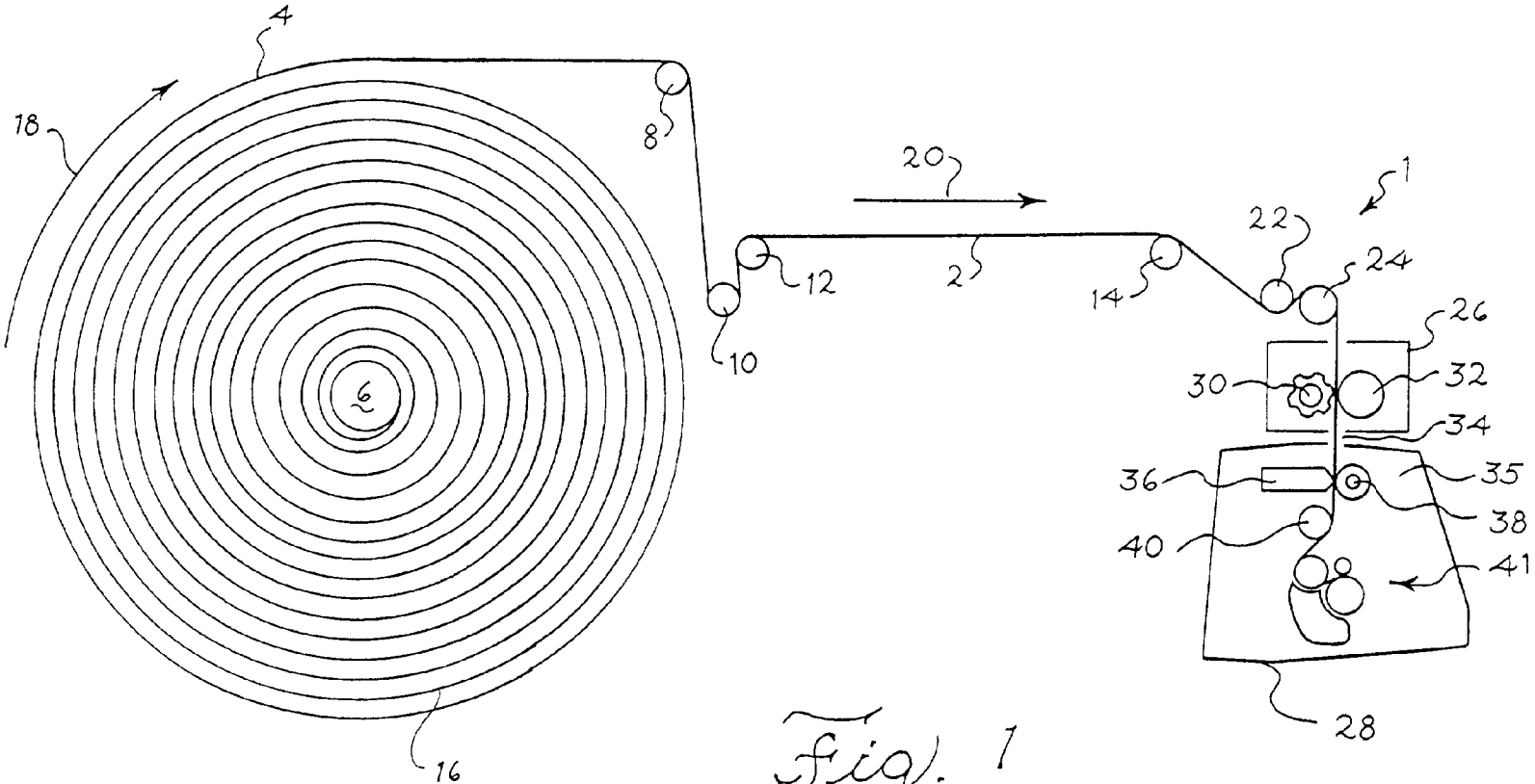
FIG. 1 is a diagrammatic view of an apparatus connected to a parent roll.

Wet rolls may be produced by applying a wetting solution to a web of material and then winding the wet web into logs or rolls of wet, wound sheet material. Referring to FIG. 1, the source web 2 may be any type of basesheet known to those skilled in the art. For example, the web may be a nonwoven basesheet, such as a dry-formed basesheet or a wet-laid basesheet, including tissue and towel basesheets. A web may be an airlaid, spun-laid, hydroentangled, spunbond, or melt-blown (for example, coform) basesheet. A sheet material may be a multi-layer basesheet, such as a laminate of any combination of these basesheets.

The term "nonwoven" means a web having a structure of individual fibers or threads which are interlaid, but not in a regular or identifiable manner as in a knitted fabric. Nonwoven fabrics or webs may be formed from many processes including, for example, meltblowing processes, spunbonding processes, air laying processes, and bonded carded web processes.

The term "coform" refers a process in which at least one meltblown diehead is arranged near a chute through which other materials are added to the web while it is forming. Such other materials may be pulp, superabsorbent particles, natural polymers (for example, rayon or cotton fibers) and/or synthetic polymers (for example, polypropylene or polyester) fibers, for example, where the fibers may be of staple length. Coform processes are described in U.S. Pat. Nos. 4,818,464 and 4,100,324, which are both commonly assigned to Kimberly-Clark. Webs produced by the coform process are generally referred to as coform materials.

An example of a useful sheet material is Kimberly-Clark Supreme Care ™ baby wipes (KIMBERLY-CLARK CORPORATION, Neenah, Wis.), as described U.S. Patent Application Publication No. 2002/0127937 A1, which is commonly assigned to Kimberly-Clark, and which is incorporated herein by reference. This type of basesheet contains coform blended with polypropylene fibers and fluff.

The basesheet may contain a binder, for example a non-dispersible binder, such as a latex binder or a cross-linkable binder; or a water-dispersible binder, such as a temperature-sensitve water dispersible binder or an ion-sensitive water dispersible binder. Ion-sensitive water-dispersible binders, such as those disclosed in the above-referenced co-pending patent applications, provide for water dispersibility of 80% or greater. Water dispersibility is defined as: 1 minus (the cross-direction wet tensile strength in water, divided by the original cross-direction wet tensile strength of the wet wipe), multiplied by 100%. Examples of individual webs include a melt-blown basesheet with a latex binder; a spun-bond basesheet with a temperature-sensitve water dispersible binder; and an airlaid basesheet with an ion-sensitve water dispersible binder.

The web is delivered to the wetting and winding apparatus 1 as a sheet of material. The web may be unwound from a roll, or it may be fed to the apparatus directly from a web making apparatus. The web may be a single sheet, or the web may have multiple sheets which are combined to form a multi-ply sheet. Multi-ply sheets may be bonded together, for example with adhesives, thermal bonding, sonic bonding, or hydroentanglement. Referring to FIG. 1, the web may be dispensed from a parent roll 4 which can be mounted on a rotating shaft 6. The spiral wind 16 of the parent roll allows the roll to be unwound in the direction of arrow 18. The unwinding of the roll can be controlled such that the web is dispensed at a consistent speed and tension even though the size of the roll is decreasing. The web is delivered in the form of a sheet to the wetting apparatus 35 in the direction of arrow 20. The delivery may be controlled by a series of rollers (8, 10, 12, 14, 22, 24) to adjust the speed of the delivery and/or the tension applied to the web. These rollers may independently be, for example, dancer rollers, idler rollers, draw rollers, or bowed rollers. The speed of the web may be at least 60 meters per minute (m/min). Preferably, the speed of the web is at least 80 m/min; more preferably at least 150 m/min; more preferably still at least 300 m/min; more preferably still at least 400 m/min.

Figure 2:
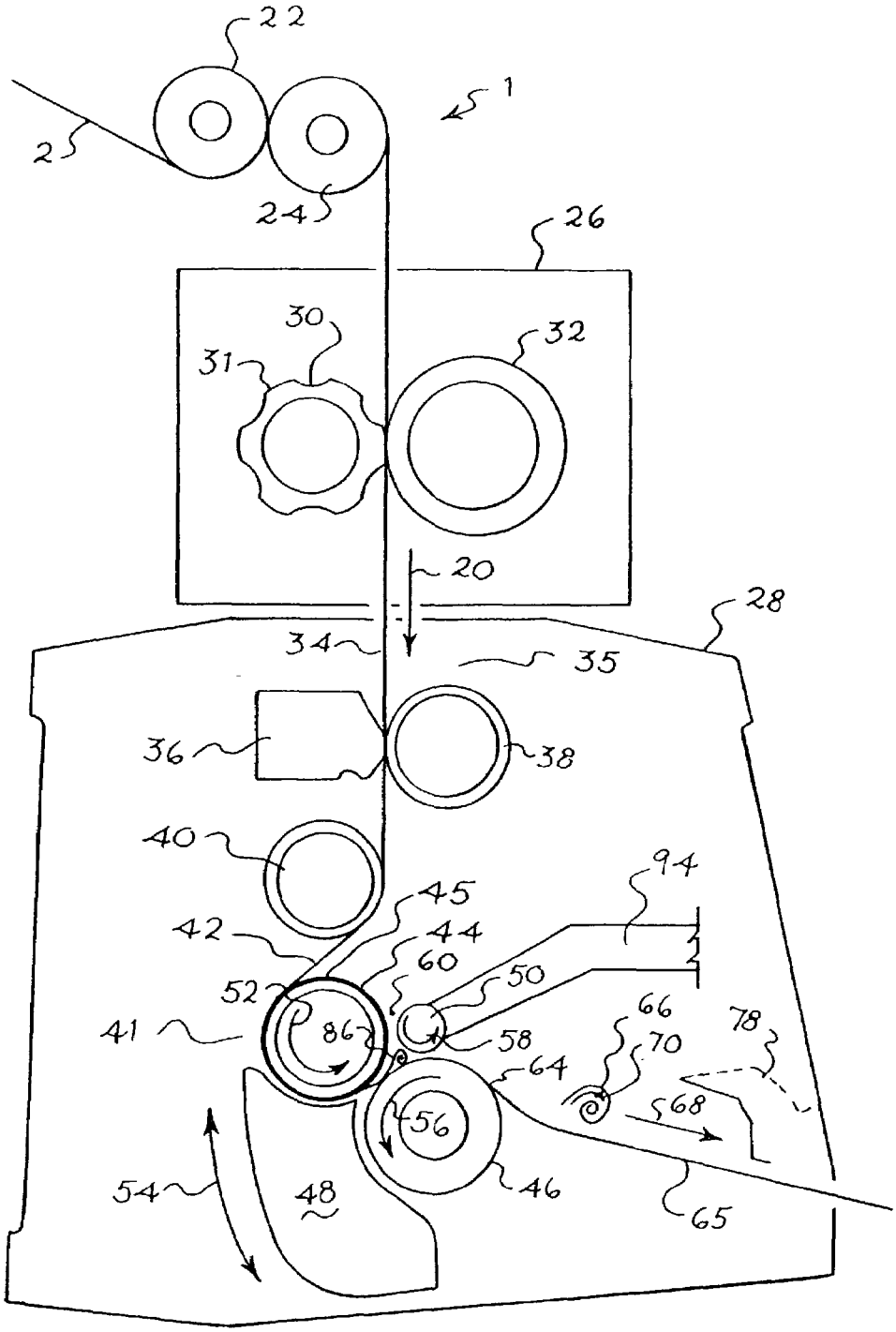
FIG. 2 is a diagrammatic view of the wetting and winding apparatus of FIG. 1.
Figure 3:
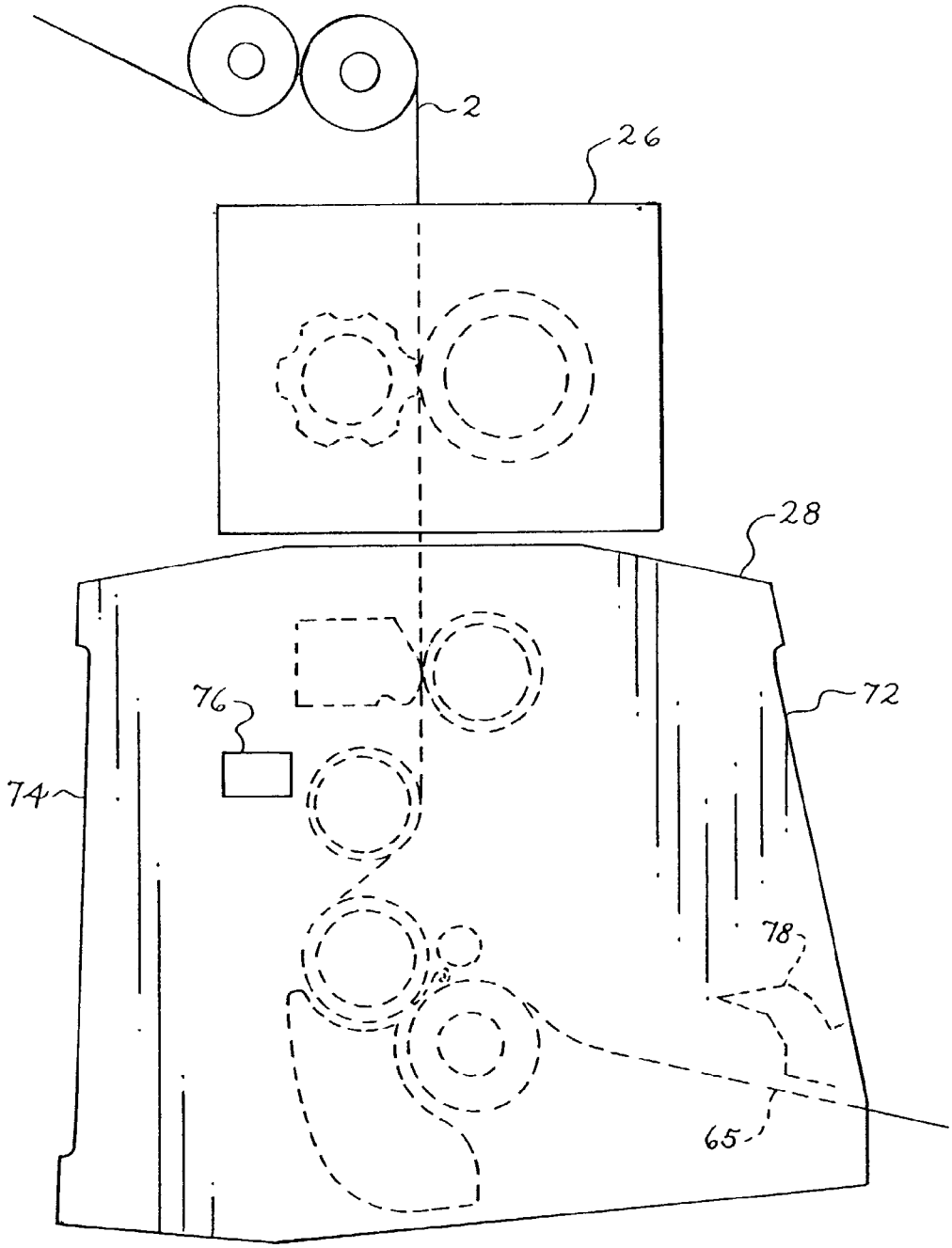
FIG. 3 is a diagrammatic view of housings for the wetting and winding apparatus of FIG. 2.

There may optionally be a device for perforating the web. Referring to FIG. 2, the perforation may be accomplished by a pair of rollers 30 and 32, wherein at least one of the rollers 30 comprises a series of teeth or blades 31 such that the impact of the rollers on the web results in incisions in a line forming a perforation line. The incisions within the perforation line may be spaced regularly, they may be spaced randomly, or they may be spaced in a controlled arrangement. The perforations are preferably in the cross direction (CD) of the web; that is in the plane of the web perpendicular to the direction of movement, or the machine direction (MD). The perforating rollers optionally may be contained in a housing 26, as illustrated in FIGS. 1–3.

The perforation may be accomplished by methods known to those skilled in the art. For example, a perforating apparatus as described in U.S. Pat. No. 5,125,302, incorporated herein by reference, may be used to perforate the web. The perforating apparatus may contain a rotating perforation roll and a stationary anvil bar. The perforation roll in this case has multiple rows of blades along the CD of the roll, and these blades protrude slightly from the face of the roll. The space between these rows and the length of the blades dictates the perforation length and spacing. The anvil bar is typically configured as a helix, for example a double helix or single helix, such that it contacts the perforation blades only at one or two positions at a time. Thus, as the perforation roll rotates, the web becomes perforated across the entire web. The web typically wraps the rotating perforation roll. The perforating apparatus may contain a rotating anvil roll with a stationary perforation blade. Typically, multiple anvil bars are configured in a helix around the anvil roll and engage the perforation blade. The web is perforated in one location at any one time. The web does not typically wrap either the anvil roll or the perforation blade. Also, the anvil roll may be kept stationary and the perforation blade may be rotated on a roll.

Referring to FIG. 2, a wetting solution may be applied to the web by wetting apparatus 35, and the wet web 42 is then delivered in the direction of arrow 20 to the wet winding apparatus 41. This delivery may be accomplished by the use of rollers or belts such as roller 40. Care must be taken in handling the wet web since the presence of moisture in the web can alter the physical properties of the material. For example, incorporation of 225% by weight of a wetting solution can increase the percent elongation at failure (i.e. "stretch") of a web from 5–10% to 25–40%. In general, the strength of the web is also decreased upon application of a given wetting solution. Typically, perforations also will diminish the strength of the wet web.

The wet winding apparatus may be any winding apparatus known to those skilled in the art. The wet winding apparatus may, for example, wind a web around a removable mandrel to produce a coreless material (U.S. Pat. Nos. 5,387,284; 5,271,515; 5,271,137; 3,856,226): The winding apparatus may, for example, wind a web around a tubular or cylindrical core (U.S. Pat. Nos. 6,129,304; 5,979,818; 5,368,252; 5,248,106; 5,137,225; 4,487,377). The winding apparatus may, for example, be a coreless surface winder which can produce coreless rolls without the use of a mandrel. (U.S. Pat. Nos. 5,839,680; 5,690,296; 5,603,467; 5,542,622; 5,538,199; 5,402,960; 4,856,725). The above applications are incorporated herein by reference. The winding apparatus is preferably a surface winder which can wind a wet web into coreless logs. Such "wet winders" are described in copending applications Ser. Nos. 09/900,516 and 09/900,746, both filed Jul. 6, 2001; in copending application Ser. No. 09/989,829, filed Nov. 19, 2001; and in copending application Ser. No. 10/024,999, filed Dec. 18, 2001; all of which are commonly assigned to Kimberly-Clark Worldwide, Inc., the disclosures of which are incorporated herein by reference.

Referring to FIG. 2, a coreless surface winder for the wet web in general can provide for continuous winding of wet coreless rolls 66. The wound roll 66 is separated from the wet web when the web is broken by the winder. It is desirable, although not required, that each roll produced by this apparatus under a given set of conditions has substantially the same number of sheets (as defined by lines of perforations) and substantially the same dimensions. The wound wet rolls are then collected or delivered for storage or further processing. The collection or delivery may be accomplished by the use of a conveyor, a collection bin, or a metering device 78 for dispensing the rolls to another apparatus.

The wetting and winding apparatus 35 and 41 may be enclosed in a containment box 28 to which the web 34 is delivered. Such a box serves to contain the wetting solution and to maintain a sanitary environment around the wet web. The area outside the box, including the dry components of the apparatus 1 and other equipment, is shielded from contact with the wetting solution. Thus, the workspace outside the box remains safe and easy to service. Containment of the wetting solution also provides for recovery of any excess solution that is not absorbed by the web. Recovered wetting solution may or may not be recycled depending on sanitary considerations. Excess wetting solution can be removed from the box by way of a drain. The drain can also provide for removal of any liquids used for cleaning the apparatus.

The setup of the wetting and winding apparatus and the containment box may be performed in an environment that is controlled to minimize airborne contaminants. The box can thus maintain the wetting and winding apparatus, the wet web, and the resultant wet rolls, in an environment which is substantially free of contaminants. Environmental parameters which may be controlled include air circulation and filtration, temperature, and humidity. The apparatus and the box may be sanitized on a periodic basis. The wetted areas inside the box may be treated with cleaning agents to eliminate any contamination, such as mold, fungus, or bacterial growth. The wetted areas may further be rinsed with clean, preferably ozonated, water, and then dried and/or treated with alcohol, such as isopropanol. Any components outside the box that come into contact with the basesheet are also preferably sprayed or wiped with alcohol. The size of the box may be large enough to allow access to the components inside the box, yet not so large that liquid could collect and contribute to contamination. In the embodiment illustrated in FIG. 3, physical access can be obtained by way of doors 72 and 74 on the sides of the box. The apparatus and the quality of the environment within the box may be monitored by way of corrosion-resistant windows 76, such as polycarbonate. The containment box may be constructed of any material which is not susceptible to corrosion, such as stainless steel. The box may be ventilated, depending on the characteristics of the wetting solution.

The wetting apparatus 35 includes a device for solution application. Examples of wetting apparatus are disclosed in the above mentioned copending applications Ser. Nos. 09/900,516; 09/900,746; 09/989,829; and 10/024,999. The wetting apparatus may optionally include a support for the web. The support may be an air plate, a set of belts or a backing roller 38. The support may be stationary, as in the case of an air plate; or it may be movable, as in the case of a roller. The support should be constructed of corrosion resistant material such as stainless steel or chrome. In the embodiment shown in FIG. 2, a backing roller 38 is adjustably mounted near the solution applicator. The roller may rotate idly or may rotate at a given speed, such as the speed of the web.

It is desirable to have even distribution of the wetting solution throughout the web in all directions. This homogenous wetting has many advantages. It can help to minimize or eliminate differences in physical properties within the web, such as strain and strength characteristics, allowing for reproducible processing of the wet product. It can help to minimize colonization and growth of contaminants. It can help to ensure consistent product quality; that is, a given roll of wet wipes will have substantially the same characteristics as another roll of wet wipes produced under specific operating conditions.

Even application of the wetting solution can help to provide uniform distribution of the ingredients initially present in the solution, such as dispersibility agents, preservatives, fragrances, or other additives. The distribution of ingredients may be uniform within the web of material in both the cross-direction and the machine-direction. Wet rolls made from such a web then may also a uniform distribution of ingredients, and this uniformity may be consistent within a roll (i.e. from the outside to the center, and from one end of the roll to the other) or from one roll to another. A uniform distribution of ingredients provides for consistent storage and dispensing characteristics of a roll of wet wipes. For example, the entire roll can be equally protected from contamination if there is uniform distribution of a preservative. In another example, the roll can be dispensed acceptably regardless of the number of sheets that remain in the roll. Dispensing characteristics include, for example, peel strength, tensile strength, and perf strength, as defined in the above mentioned U.S. application Ser. No. 09/659,307. These may be independently affected by the distribution of the wetting solution.

Examples of wetting solutions are given in the above mentioned U.S. Pat. Nos. 6,423,804 B1; 6,429,261 B1; 6,444,214 B1; and in copending U.S. patent applications Ser. Nos. 09/564,449; 09/565,125; 09/564,837; 09/564,531; 09/564,268; 09/564,424; 09/564,780; 09/564,212; 09/565,623; and 09/900,698. Wetting solutions are desirably aqueous compositions which are compatible with binder compositions which may be present in the web, such as ion-sensitive binder compositions. The wetting solution may enable the wetted web to maintain its wet strength during converting, storage and usage (including dispensing), while also exhibiting dispersibility in a toilet bowl. The wetting solution may also exhibit some or all of the following exemplary characteristics: it does not cause skin irritation; it reduces tackiness of the wipe; it provides unique tactile properties such as skin glide and a "lotion-like feel"; and/or it acts as a vehicle to deliver "moist cleansing" and other skin health benefits.

The wetting solution can contain an activating compound that maintains the strength of an ion-sensitive water-dispersible binder until the activating compound is diluted with water, whereupon the strength of the water-dispersible binder begins to decay. The activating compound in the wetting solution can be a salt, such as sodium chloride, or any other compound, which provides in-use and storage strength to the water-dispersible binder composition and can be diluted in water to permit dispersion of the substrate as the binder polymer triggers to a weaker state. Desirably, the wetting solution contains less than about 10 weight percent of an activating compound based on the total weight of the wetting solution. More desirably, the wetting solution may contain from about 0.3 weight percent to about 5 weight percent of an activating compound, more desirably from about 2 weight percent to about 4 weight percent of an activating compound.

The wetting solution may further contain a variety of additives compatible with the activating compound and the water-dispersible binder, such that the strength and dispersibility functions of the web are not jeopardized. Suitable additives in the wetting solution include for example, skin-care additives; odor control agents; detackifying agents to reduce the tackiness of the binder; particulates; antimicrobial agents; preservatives; wetting agents and cleaning agents such as detergents, surfactants, and some silicones; emollients; surface feel modifiers for improved tactile sensation (e.g., lubricity) on the skin; fragrance; fragrance solubilizers; opacifiers; fluorescent whitening agents; UV absorbers; pharmaceuticals; and pH control agents, such as malic acid or potassium hydroxide.

A variety of wetting solutions may be used with to wet the web. For example, the wetting solution can contain the following components, given in weight percent of the wetting solution, as shown in Table 1:

TABLE 1

Wetting Solution Components

| Wetting Solution Component: | Weight Percent: |
|---|---|
| Deionized Water | about 86 to about 98 |
| Activating compound | about 1 to about 6 |
| Preservative | Up to about 2 |
| Surfactant | Up to about 2 |
| Silicone Emulsion | Up to about 1 |
| Emollient | Up to about 1 |
| Fragrance | Up to about 0.3 |
| Fragrance solubilizer | Up to about 0.5 |
| pH adjuster | Up to about 0.2 |

In other examples, the wetting solution may contain one of the following sets of components, given in weight percent of the wetting solution, as shown in Tables 2, 3 and 4:

TABLE 2

An Exemplary Wetting Solution

| Class of Wetting Component: | Specific Wetting Component: | Component Name: | Weight Percent: |
|---|---|---|---|
| Vehicle | Deionized Water | | about 86–about 98 |
| Activating compound | Sodium Chloride (Millport Ent., Milwaukee, WI) | | about 1 to about 6 |
| Preservative | Glycerin, IPBC and DMDM Hydantoin | Mackstat H-66 (Mclntyre Group, Chicago, IL) | Up to about 2 |
| Surfactant | Acyl Glutamate | CS22 (Ajinomoto, Tokyo) | Up to about 2 |
| Silicone Emulsion (Detackifier/Skin Feel agent) | Dimethiconol and TEA Dodecylbenzene Sulfonate | DC1785 (Dow Corning, Midland, MI) | Up to about 1 |
| Emollient | PEG-75 Lanolin | Solulan L-575 (Amerchol, Middlesex, NJ) | Up to about 1 |
| Fragrance | Fragrance | Dragoco 0/708768 (Dragoco, Roseville, MN) | Up to about 0.3 |
| Fragrance solubilizer | Polysorbate 20 | Glennsurf L20 (Glenn Corp., St. Paul, MN) | Up to about 0.5 |
| pH adjuster | Malic Acid to pH 5 (Haarman & Reimer, Tetrboro, NJ) | | Up to about 0.2 |

TABLE 3

An Exemplary Wetting Solution

| Class of Wetting solution Component: | Specific Wetting solution Component: | Component Name: | Weight Percent: |
|---|---|---|---|
| Vehicle | Deionized Water | | about 93 |
| Activating compound | Sodium Chloride | | about 4 |
| Preservative | Glycerin, IPBC and DMDM Hydantoin | Mackstat H-66 | about 1 |
| Surfactant | Acyl Glutamate | CS22/ECS 22P | about 1 |
| Silicone Emulsion | Dimethiconol and TEA Dodecylbenzene Sulfonate | DC 1784/ DC1785 | about 0.5 |
| Emollient | PEG-75 Lanolin | Solulan L-575 | about 0.25 |
| Fragrance | Fragrance | Dragoco Fragrance 0/708768 | about 0.05 |
| Fragrance solubilizer | Polysorbate 20 | Glennsurf L20 | about 0.25 |
| PH adjuster | Malic Acid to pH 5 | | about 0.07 |

TABLE 4

An Exemplary Wetting Solution

| Class of Wetting solution Component: | Specific Wetting solution Component: | Component Name: | Weight Percent: |
|---|---|---|---|
| Vehicle | Deionized Water | | about 94 |
| Activating compound | Sodium Chloride | | about 4 |
| Preservative | Glycerin, IPBC and DMDM Hydantoin | Mackstat H-66 | about 1 |
| Surfactant | Sodium Cocoyl Glutamate | | about 0.25 |
| Silicone Emulsion | Dimethiconol and TEA Dodecylbenzene Sulfonate | DC 1784/ DC1785 | about 0.25 |
| Fragrance | Fragrance | Firmenich, Cocoon Fragrance 161.086 | about 0.10 |
| Fragrance solubilizer | Polysorbate 20 | Glennsurf L20 | about 0.25 |
| PH adjuster | Malic Acid to pH 5 | | about 0.035 |

It should be noted that these wetting solutions may be used with any one of the ion-sensitive binder compositions described in the U.S. Patents and copending applications referenced above, and may be used with any other binder composition, including conventional binder compositions, or with any known fibrous or absorbent substrate, whether dispersible or not.

Desirably, the wetting solution is added to the web with an add-on greater than about 25%. The amount of liquid or wetting solution contained within a given wet web can vary depending on factors including the type of basesheet, the type of liquid or solution being used, the wetting conditions employed, the type of container used to store the wet wipes, and the intended end use of the wet web. Typically, each wet web can contain from about 25 to about 600 weight percent and desirably from about 200 to about 400 weight percent liquid based on the dry weight of the web. To determine the liquid add-on, first the weight of a portion of dry web having specific dimensions is determined. The dry web corresponds to the basesheet which can be fed to the wetting and winding apparatus. Then, the amount of liquid by weight equal to a multiple (e.g. 1, 1.5, 2.5, 3.3, etc., times) where 1=100%, 2.5=250%, etc., of the portion of the dry web, or an increased amount of liquid measured as a percent add-on based on the weight of the dry web portion, is added to the web to make it moistened, and then referred to as a "wet" web. A wet web is defined as a web which contains a solution add-on between 25% and the maximum add-on which can be accepted by the web (i.e. saturation). Preferably, the wetting solution add-on is between about 25% and 700%; more preferably between 50% and 400%; more preferably still between 100% and 350%; more preferably still between 150% and 300%; more preferably still between 200% and 250%.

Complete absorption of the wetting solution helps to minimize the amount of excess liquid on the web and thus on the components of the apparatus. Incomplete absorption can be problematic even in the final wet product which is made from the wet web. It is desirable that the final wet product does not express liquid under normal handling and use, including packaging and dispensing. The wetting and winding apparatus may be separated by a distance such that the wetting solution can be completely absorbed by the web as it travels between the wetting apparatus and the winding apparatus. This travel time may range from less than one second to about one minute. The rate of absorption can depend on many factors, including the type of basesheet, the characteristics of the binder, and the composition used as the wetting solution.

The configuration of the wetting and winding apparatus may, however, be limited, for example by space constraints or other manufacturing considerations. If there is not a sufficient distance between the apparatus, it may be desirable that the wetting solution is absorbed in a shorter time than is necessary for absorption due to simple contact between the web and the wetting solution. Higher rates of absorption can allow for higher machine speeds and increased product throughput.

Numerous parameters may be controlled in order to influence the degree and/or rate of absorption of the wetting solution, as well as the amount of solution that is wasted and/or recycled. These parameters include, for example the solution add-on level, the temperature of the wetting solution, the geometry of impingement of the solution, and the pressure applied to the web during and/or after the solution application. Ideally, the wetting solution is applied evenly along the entire cross-direction of the web.

Figure 4:
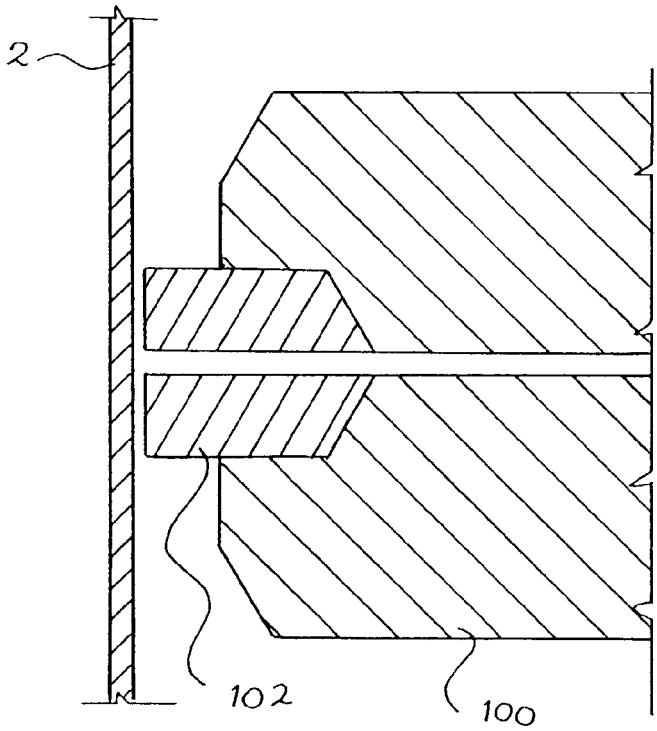
FIG. 4 is a diagrammatic view of a fluid distribution header.

The wetting solution can be applied by methods known to those skilled in the art. The wetting apparatus may contain, for example, a fluid distribution header, such as a die with a single orifice; a drool bar; a spray boom, such as a boom with multiple nozzles; or press rolls. The apparatus may contain, for example, a fluid distribution header 100 with an adjustable die 102 (FIG. 4). The size of the orifice in the die, the temperature of the die, and the volume of solution applied may be controlled such that the liquid exits the die with a uniform pressure, temperature, and geometry.

Figure 5:
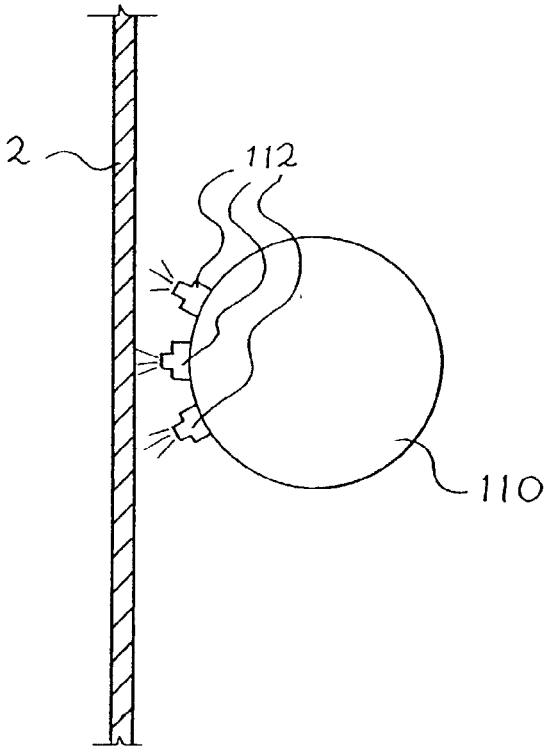
FIG. 5 is a diagrammatic view of a spray boom.
Figure 15:
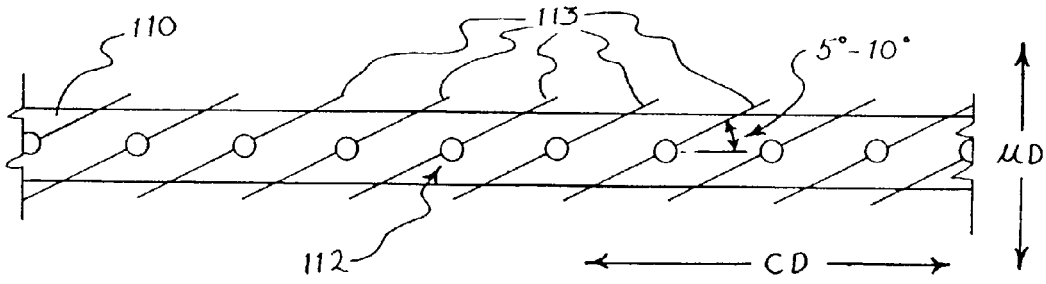
FIG. 15 is a diagrammatic view of a spray boom.

The apparatus may contain a spray boom 110 with multiple nozzles 112 (FIG. 5). The distribution of the nozzles along the boom, as well as their orientation with respect to the web, may be adjusted to provide for substantially uniform application of liquid. For example, the spray boom may include a pipe which extends across the cross-direction of the web. This pipe may have nozzles across its length that spray the wetting solution onto the web. The distance between the individual nozzles and the distance between the nozzles and the web can affect the uniformity of application of the solution. It is desirable that the sprays from the nozzles do not interfere with each other when impinging the web. To help prevent this interference, it may be beneficial for the nozzles to be "shingled." That is, the orientation of the nozzles may be rotated from being in line with each other in the cross-direction. Referring to FIG. 15, the nozzles 112 may be arranged in a single line and may be rotated 5–10 degrees from the cross-direction line so that the sprays 113 do not physically interfere with each other. The amount of solution delivered to the boom and its nozzles may be adjusted according to the speed of the web. Thus, a uniform amount of solution may be applied, not only in the cross-direction, but also in the machine-direction regardless of the speed of the web. For high machine speeds, it may be desirable to use nozzles having larger orifices and/or to utilize more than one spray boom. Multiple spray booms may be employed to deliver amounts of solution which are different or which are the same.

Figure 9:
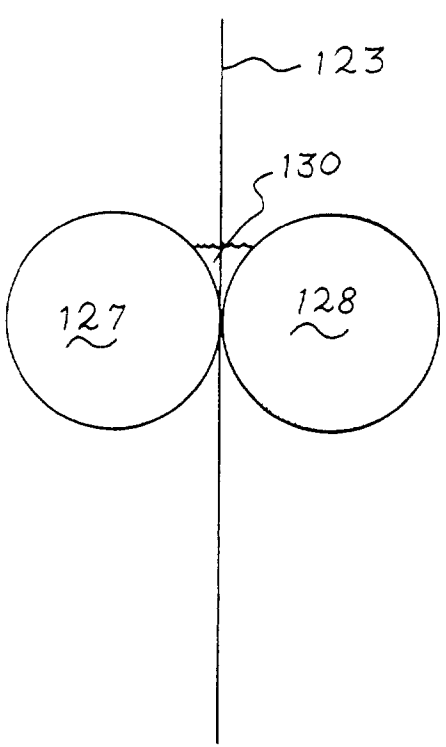
FIGS. 7–9 are diagrammatic views of nips for a wetting apparatus.
Figure 8:
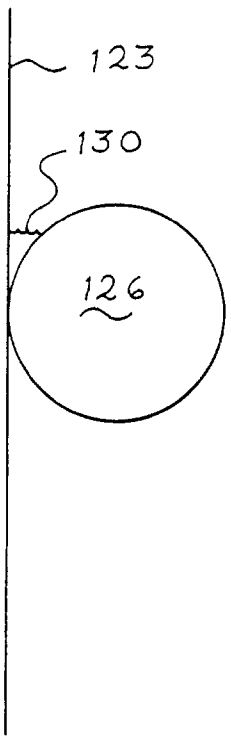
Figure 7:
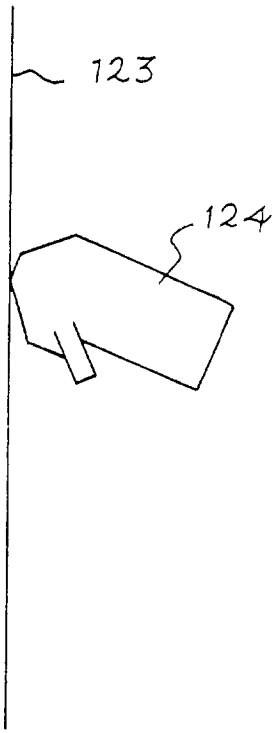
Figure 10:
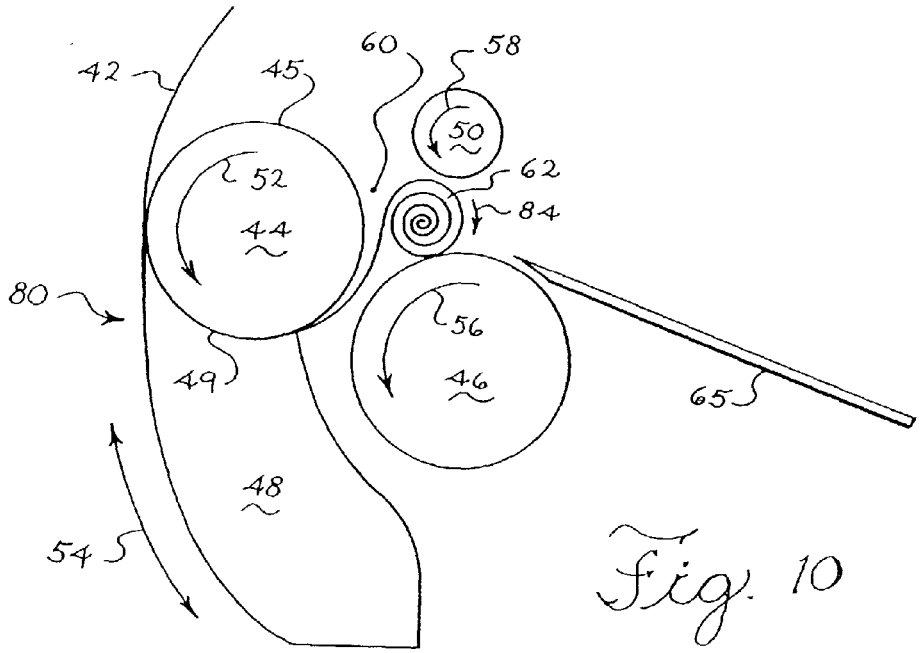
FIGS. 10–11 are diagrammatic views of a wet winding apparatus.

The wetting apparatus may include the use of a nip to improve distribution and absorption. A nip may be formed by the convergence of a web 123 and a header 124 (FIG. 7), a web 123 and a roller 126 (FIG. 8), or two rollers 127 and 128 (FIG. 9). In these embodiments, the application of fluid 130 is controlled by parameters including the distance between the elements forming the nip. Solution application may be accomplished by the use of other apparatus known to those skilled in the art. For example, the web may be passed through a bath or trough containing the wetting solution. The web may be wetted by contact with a material that is wet, such as a wetted belt or roller or a wet sponge. The application of solution may be accomplished in more than one step; that is by two or more wetting steps, which may be the same or different.

A fibrous web which has been treated with an ion-sensitive water-dispersible binder is typically hydrophobic. As used here in relation to substrates, "hydrophobic" or "nonwettable" describes fibers or surfaces of fibers that are not wetted by the aqueous liquids in contact with the fibers. The degree of wetting of the materials can be described in terms of contact angles and the surface tensions of the liquids and materials involved. Equipment and techniques suitable for measuring the wettability of particular fiber materials or blends of fiber materials can be provided by a Cahn SFA-222 Surface Force Analyzer System. When measured with this system, fibers having contact angles greater than 90° are "nonwettable", ie, "hydrophobic", and fibers having contact angles less than 90° are designated "wettable", ie, "hydrophilic".

A substrate or web which is hydrophobic tends to repel water-based substances, thus inhibiting the absorption of aqueous solutions into the web. If the applied wetting solution is not completely absorbed into the web, the web will not interact properly with the processing apparatus. For example, excess liquid on the surface of the web may function as a lubricant layer between the web and the components of the processing apparatus. This can make it difficult or impossible to process the web using frictional interactions, such as those employed by wet winding methods as described below and in the above mentioned co-pending applications Ser. Nos. 09/900,516; 09/900,746; 09/989,829; and 10/024,99. Slow absorption can also cause processing problems. The properties of a wetted web are significantly different than those of a dry web, and the transition of a web from dry to wet can require precise control of the handling of the web. If the wetting solution takes too long to be absorbed into the web, the transition is made even more difficult due to the uncertainty in web characteristics.

A hydrophobic web material can absorb an aqueous wetting solution rapidly if the wetting solution is forced into the web by an applied pressure. Pressure can be applied to the web in a variety of ways, including the use of a pair of press rolls. These press rolls are analogous to the rolls used in size-press technology for applying binders during the formation of a web of material. Size presses are generally used to apply a binder, also referred to as a sizing material, to a fibrous web during the formation of the web. Typically, conventional size presses are used to decrease the amount of liquid that is absorbed by a web, whereas the press rolls of the wetting apparatus are used to maximize the liquid which is absorbed by the web. Also, unlike conventional size presses, which apply additives to a web in the process of making a final dry product, the press rolls of a wetting apparatus apply a wetting solution to a dry sheet to provide a final product that is moist, for example containing at least 25% solution add-on.

Figure 6:
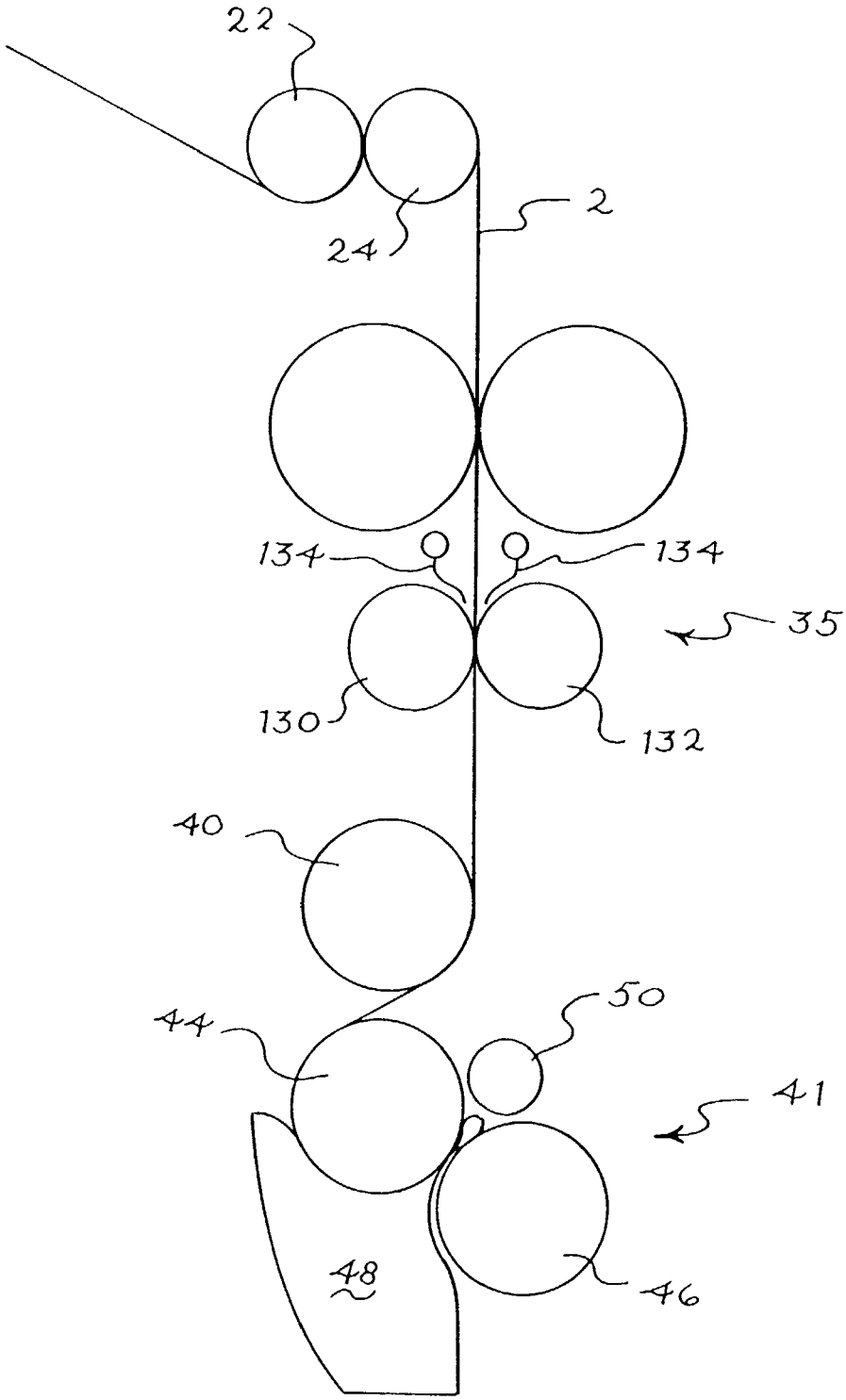
FIG. 6 is a diagrammatic view of a wetting and winding apparatus with press rolls.

Referring to FIG. 6, the wetting apparatus may optionally include a set of press rolls. For example, the press rolls 130 and 132 may be rubber-covered rolls positioned to contact the web. The wetting solution 134 may be applied to the web, for example by a fluid distribution header or a spray boom. The wetting solution may also be applied to the press rolls, for example by a set of drool bars. The press rolls may be configured to apply force to the web, such that the solution is forced into the basesheet. This can help prevent a film of excess solution from forming on the surface of the sheet. The interaction of the press rolls with the web may be modified as needed to provide for complete solution absorption. For example, the press rolls may be removed from contact with the web if the absorption is sufficiently complete without added pressure. The press rolls may, for example, contact the web with a pressure that is controllable and which can be adjusted to modify the rate of absorption.

The wetting apparatus may thus include two rubber covered press rolls which are driven to rotate on their respective axes. The rolls can be nipped, or they can be positioned to provide for a controlled gap between the rolls. The relative positioning of the rolls can be controlled by methods known to those skilled in the art, including air cylinders, servo motors, and cam arrangements. The press rolls may be covered with rubber, an elastomer, or any material which will assist in the spreading and the application of the wetting solution. Desirably, the roll cover has a hardness between 70 and 95 Shore A durometer and a thickness of about 20 mm. Desirably, the gap between the press rolls is between zero (i.e. nipped) and 0.75 mm. More preferably, the gap is between 0.2 mm and 0.7 mm.

The wetting solution may be dispensed through a drool bar having holes spaced along the entire width of the web. Desirably, the holes have a diameter of 3/32 inch and are spaced from each other by 3/8 inch. The wetting solution may be applied directly to the web, or it may be applied to the press rolls. The wetting solution may be applied from the drool bar to the press rolls. In this way, the liquid is allowed to spread out, and the motion of the rolls carries the solution to the nip, through which the web passes. The amount of solution applied can be controlled according to the operating speed of the web formation and/or the speed of processing. The wetting solution may be dispensed through a spray boom 110 (FIG. 5).

The press roll wetting apparatus can provide improved processing parameters compared to conventional wetting apparatus. The add-on levels for solution application facilitated by the press rolls can be 25% greater than those attainable by standard solution application techniques under the same conditions. In comparing the liquid add-on attainable by the press rolls to the add-on provided by conventional wetting processes, the web is characterized by a "conventional add-on." The conventional add-on is defined as the maximum liquid add-on which can be absorbed under conventional wetting techniques without the use of press rolls. The add-on provided by the wetting apparatus including press rolls can be at least 15% greater than the conventional add-on. Desirably, the add-on provided by the use of press rolls is at least 25% greater than the conventional add-on, and more preferably is at least 30% greater than the conventional add-on. For example, in wetting identical hydrophobic webs at the same web speed and solution flow rates, a slot die wetting apparatus provided an add-on of 189%, whereas a press roll wetting apparatus provided an add-on of 252%, which is 33% greater than the conventional add-on.

The add-on level can be adjusted by modifying the operating parameters of the press roll wetting apparatus. For example, in wetting one type of hydrophobic web, the add-on was increased from 239% to 278% when the press roll gap was reduced from 0.40 mm to 0.13 mm. For another type of hydrophobic web, the add-on increased from 220% to 261% when the gap was reduced from 0.5 mm to no gap (nipped). Webs containing hydrophilic binders do not exhibit an increase in add-on when the press roll gap is decreased. The press roll wetting apparatus can be used to provide complete absorption of applied wetting solutions for operating speeds up to 300 meters per minute (m/min), preferably up to 330 m/min, more preferably up to 400 m/min.

The primary set of press rolls may be complemented by a secondary set of press rolls between the primary set and the processing apparatus. This secondary set of press rolls can provide for 100% absorption of the wetting solution for a given add-on target. The secondary set of press rolls can also serve to remove any unabsorbed solution from the surface of the web. This liquid can be removed from the rolls, for example with a doctor, such that the rolls are dry when they impinge on the web.

The application of a uniform amount of wetting solution to the web before winding the web into a roll can provide for a uniform distribution of ingredients throughout the roll. This, in turn, can provide for consistent product quality and for consistent properties of an individual roll which may be used by a consumer. For example, in wet rolls made from a basesheet with an ion-sensitive water-dispersible binder, an even distribution of an inorganic salt, such as sodium chloride (NaCl), potassium chloride (KCl) or potassium bromide (KBr), can ensure that any given portion of a wet roll will disperse in water at an acceptable rate. Also, the presence of a uniform distribution of inorganic salt can ensure that none of the roll will experience a decrease in wet strength, for example, during production, storage, or use. In another example, a set of preservatives may be used in the wetting solution to guard against contamination of the wet roll. Insufficient preservative levels in a portion of a roll can allow the presence and/or growth of contaminants, even if the remainder of the roll is adequately protected. Accumulation of preservative in a portion of a roll can cause the wet sheet to have an undesirable feel and/or wiping properties. An excess of preservative, in some areas of the sheet, could contribute to allergic or irritant contact dermatitis if that area was wiped on the skin. A uniform distribution of ingredients can prevent the occurrence of either of these extremes.

Uniformity of ingredients within a wet roll is determined by analyzing samples of the roll according to the following representative method. The method of analysis of ingredients may be chosen depending on the product to be analyzed, as well as the surrounding environment. The roll is unwound, and the first five sheets, the middle five sheets, and the last five sheets are removed. These sets of sheets correspond the outside portion of the roll, the portion of the roll midway between the outside and the center, and the center of the roll, respectively. Each set of sheets is then folded and cut into three equal sections corresponding to the left, middle, and right of the roll when the roll is viewed perpendicular to its axis. The sections are individually stored in airtight, moisture loss resistant containers. An individual section is placed in a syringe and compressed to express the solution. This solution is then diluted and tested for chloride using ion chromatography and tested for acid using ion-exclusion liquid chromatography. The chloride data can be converted into data for the inorganic salt level. For wipes which do not express sufficient liquid, the section is extracted with 1:1 methanol and water for 12 hours in an orbital shaker. The section from which liquid has been expressed or extracted is dried in an oven at 60° C. for 36 hours to a constant weight. The dried section is extracted with methanol in an orbital shaker for 12 hours. An aliquot of the extract is dried, and the solids are extracted with the mobile phase to be used for liquid chromatography. Liquid chromatography is used to determine the amount of non-acid preservative. For the measurement of IPBC, a section taken directly from the wet roll is dried in an oven at 60° C. for 36 hours to a constant weight and extracted for 4 hours with methanol. An aliquot of the extract is dried, the solids are extracted with the mobile phase, and the amount of IPBC is determined by liquid chromatography.

For a wet roll which was formed by the wetting and winding process and apparatus described herein and using a wetting solution containing sodium chloride as the inorganic salt and containing iodopropynyl butylcarbamate (IPBC), DMDM Hydantoin, and malic acid as the preservatives, the data for the distribution of the inorganic salt and for the distribution of the preservatives are given in Table 5.

TABLE 5

| Sheets/Section | Left | Middle | Right |
|---|---|---|---|
| | Sodium Chloride (%) | | |
| Outer 5 | 4.40 | 4.37 | 4.37 |
| Middle 5 | 4.35 | 4.30 | 4.41 |
| Inner 5 | 4.35 | 4.68 | 4.35 |

TABLE 5-continued

| Sheets/Section | Left | Middle | Right |
|---|---|---|---|
| | IPBC (μg/g) | | |
| Outer 5 | 65 | 35 | 39 |
| Middle 5 | 52 | 33 | 26 |
| Inner 5 | 30 | 30 | 35 |
| | DMDM Hydantoin (ppm) | | |
| Outer 5 | 2460 | 2410 | 2390 |
| Middle 5 | 2310 | 2270 | 2300 |
| Inner 5 | 2210 | 2320 | 2220 |
| | Malic acid (ppm) | | |
| Outer 5 | 439 | 495 | 432 |
| Middle 5 | 424 | 428 | 421 |
| Inner 5 | 423 | 433 | 454 |

The variability of the distribution of an ingredient is defined as the standard deviation as a percentage of the average mean value for all the data points obtained. For example, for the sodium chloride data above, the mean value is 4.40 with a standard deviation of 0.11, which is 2.5% of the mean value. Thus, the sodium chloride values have a variability of 2.5%. The variabilities for IPBC, DMDM Hydantoin, and malic acid are 32.5%, 3.7%, and 5.3%, respectively. It is preferred that the inorganic salt has a variability of less than about 20%, more preferably less than about 10%, more preferably still less than about 5%, more preferably still less than about 3%. It is noted that the inorganic salt is considered an additive only when present at a level of at least about 0.5%, more preferably at least about 1.0%. Some inorganic salt may be present in any wetting solution at levels below these loadings, for example due to water impurities or residual cleaning solutions. For the preservatives in the wet roll, it is preferred that all preservatives individually have a variability of less than about 60%, more preferably less than about 50%, more preferably still less than about 40%, more preferably still less than about 35%. The above are examples of the uniformity of addition of ingredients that may be obtained with the present invention. Such uniformity may also be obtained for other additives and types of additives, and this invention is not limited to those additives exemplified above.

Referring to FIGS. 2 and 6, the wetting apparatus may optionally include a detour roller 40 positioned to contact the web after the solution application and before the wet winding. This roller assists in transferring the wet web from the wetting apparatus to the winding apparatus. The detour roller can provide a frictional surface to ensure adequate tension in the web. This can be especially advantageous during the separation of a completely wound wet log from the rest of the web. Also, the detour roller can provide a preferred geometry between the web and the winding apparatus to ensure adequate contact between the wet web and the upper winding roller of the winding apparatus.

Figure 11:
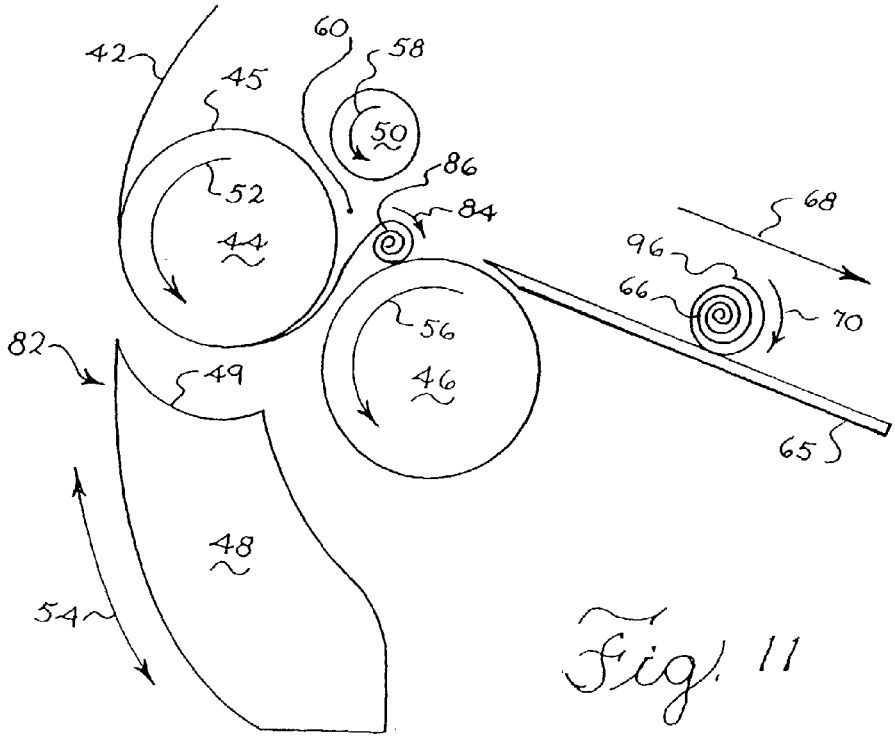
Figure 12:
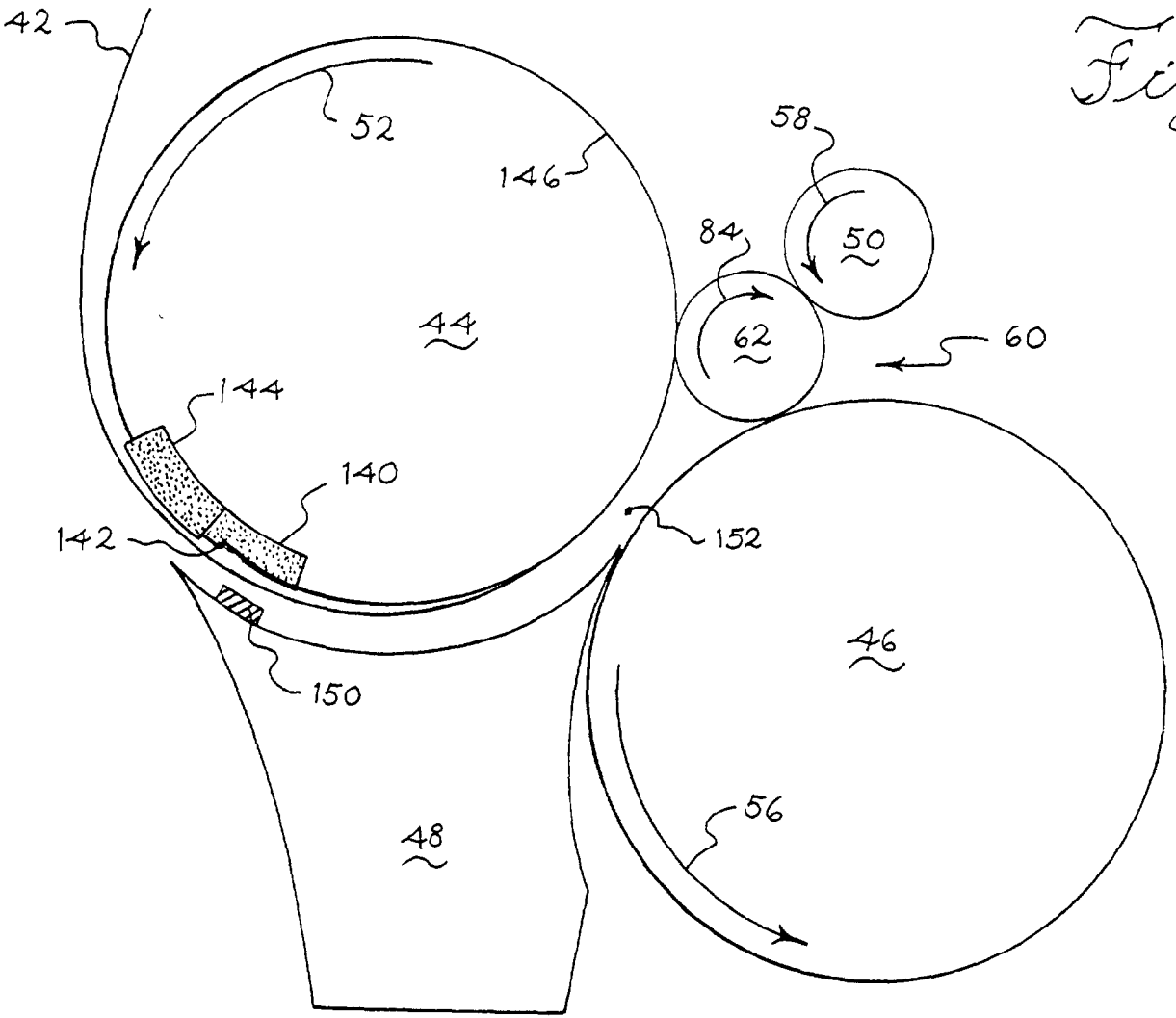
FIG. 12 is a diagrammatic view of the winding rollers and transfer shoe.
Figure 13:
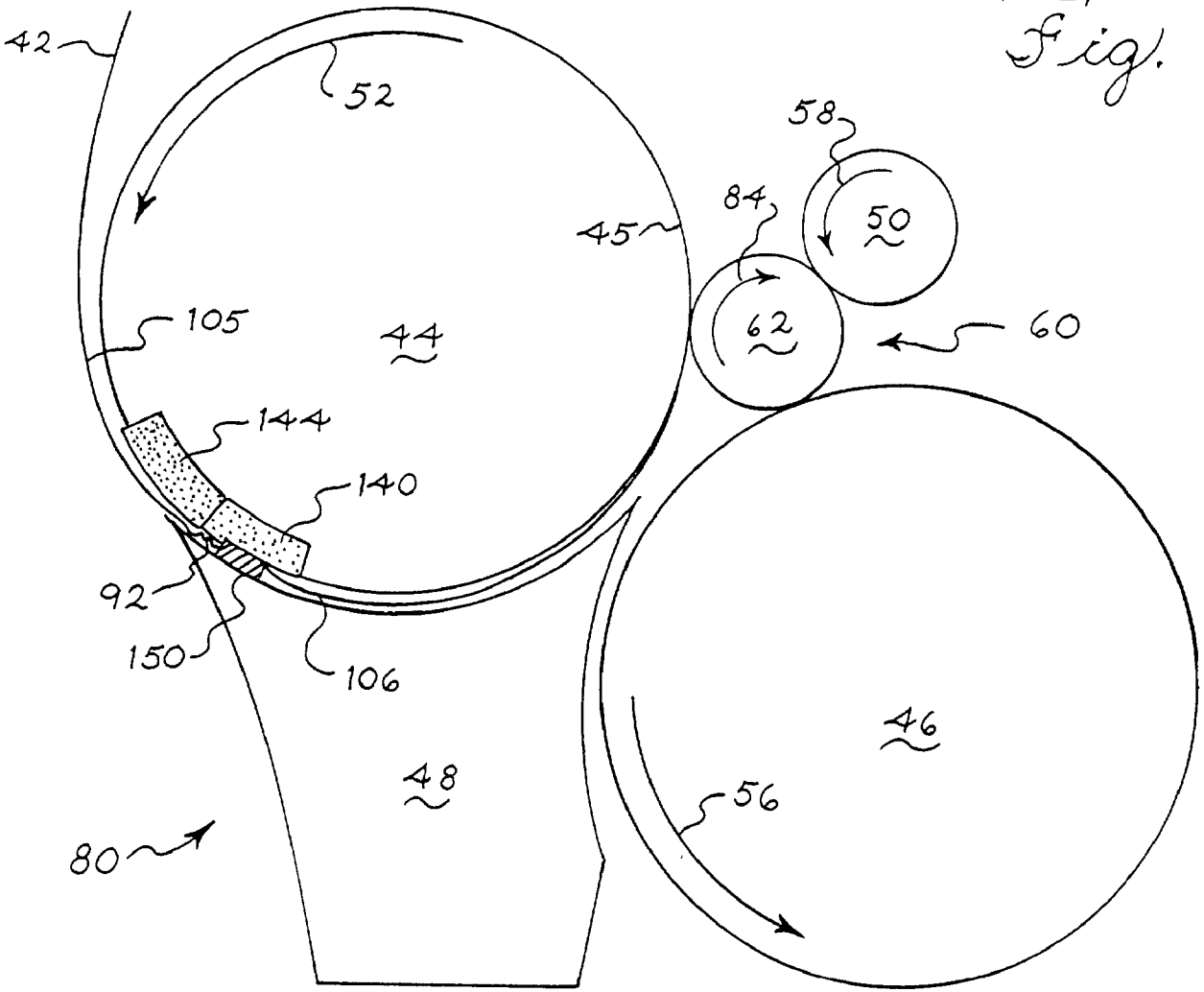
FIG. 13 is a diagrammatic view of the winding rollers and transfer shoe, illustrating the breaking of the web.

Referring to FIGS. 10–13, the wet winding apparatus 41 includes an upper winding roller 44, a lower winding roller 46, and a rider roller 50. The upper winding roller rotates in the direction of arrow 52, so that, when in contact with the wet web, it is moving in the same direction as the web. At a point downstream from the point where the web 42 and the upper winding roller meet, the lower winding roller 46 contacts the exposed side of the web. The lower winding roller rotates in the direction of arrow 56, which is opposite that of the motion of the wet web when the roller and web are in contact. It follows that the upper and lower winding rollers rotate in the same circular direction (i.e. clockwise or counter-clockwise). The contact of both the upper winding roller and the transfer shoe 48 on the web breaks the web into a downstream portion 106 and an upstream portion 105 (FIG. 13). This contact also causes the leading edge of the upstream portion of the web to fold or bunch together into an embryonic roll, called a cigarette 86. The cigarette 86 is caused to rotate in the circular direction 84, which is opposite that of the winding rollers, to form a roll 62. The rider roller 50 is positioned to contact the rotating roll 62 after the point of contact between the winding rollers. The convergence of the rider roller with the winding rollers forms a roll winding pocket 60. The rider roller rotates in the same circular direction 58 as the winding rollers, thus coordinating with the winding rollers to promote rotation of the wet web, in the direction of arrow 84, into a wet roll 62. The rider roller also helps prevent the wet roll from leaving the pocket before a roll of the desired dimensions and/or sheet content is formed.

The upper winding roller preferably has a high friction surface 45 to stabilize the wet web on the roller. A high friction surface is defined as having a surface roughness greater than 250 roughness average (Ra). The friction of a surface can also be quantified in terms of coefficient of friction, in which a higher coefficient of friction corresponds to a higher friction surface. Roughness average is measured by a profilometer, and is based on a graphical centerline, which is the line through the profile of the surface where the sums of the area on either side of the line (peaks and valleys) are equal. Roughness average is defined as the arithmetic average of the height of the peaks above the graphical centerline over a given area, and is expressed in units of microinches (0.000001 inch). The graphical centerline is the least-squares best fit line through the profile data. An example of a profilometer is the Model S5 TALYSURF Surface Profilometer (RANK TAYLOR HOBSON, LTD., Leicester, England). The Ra of a surface can be measured following the procedures described in U.S. Pat. No. 6,140,551, which is incorporated herein by reference, using a single line trace of the surface and a "cut-off" length of 0.8 mm. For example, an 8 mm sampling length would consist of 10 cut-offs of 0.8 mm each.

A presently preferred material for the surface 45 of the upper winding roller is tungsten carbide. Preferably, the surface of the upper winding roller has a roughness of at least about 300 Ra, more preferably at least about 500 Ra, more preferably still at least about 600 Ra, and more preferably still at least about 700 Ra. It is desirable to wind the wet web without the use of vacuum rollers, which contain vacuum ports on their surface to ensure stability of the web. The wetting solution, especially if present in excess (i.e. not fully absorbed by the web), can accumulate on the surface of the web and can also be transferred to the rollers and/or other components of the wet winding apparatus. A high friction surface on the upper winding roll can help to compensate for the decrease in the coefficient of friction of the web due to the presence of the wetting solution. The position of the upper winding roller relative to the detour roller may provide for the web to wrap around a portion of the upper winding roller. Typically, at least 10%. of the surface area of the upper winding roller contacts the web. The detour roller preferably has a high friction surface, which may be made of tungsten carbide. More desirably, the surface roughness of the detour roller is at least about 300 Ra, more preferably still at least about 500 Ra.

Referring to FIG. 12, the upper winding roller may also contain two regions which extend across the roller in the cross direction. The downstream region 140 has a smooth surface of stainless steel and has a slightly raised area 142 approximately halfway across the face of the insert. The upstream region 144 is approximately 0.5 mm taller than the raised smooth region. The upstream region also has a plurality of grooves in the cross direction which provide a higher surface roughness than the remainder of the tungsten carbide surface 146. The upstream region may have channels cut into the insert, and these channels may be in the cross-direction and/or the machine direction. Channels in both the cross-direction and the machine-direction may provide an array of flat-top pyramids. For example, the channels may be cut at angles of 60 degrees with a pitch of 1.12 mm, and each flat-top pyramid may have a height of 0.7 mm. The flat surface of the pyramids may further have a tungsten carbide coating to provide a high friction surface.

The coordinated action of the upper winding roller and the transfer shoe 48 on the web results in the beginning of the formation of a log. The transfer shoe is a preferably a rigid material with a high friction surface. The transfer shoe also has a concave surface 49 with a radius of curvature that is substantially the same as that of the upper winding roller. The curvature may be interrupted by a ridge 150. The transfer shoe may be mounted so that it can move along the directions of arrow 54 in an indexing motion. To start the winding of a new log, the transfer shoe is indexed towards the upper winding roller. The shoe is illustrated in the raised position 80 in FIG. 10 and in the lowered position 82 in FIG. 11. The rate and/or frequency of movement of the transfer shoe may be adjustable so as to provide for rolls of different dimensions or to accommodate other substrates or machine speeds.

Figure 14:
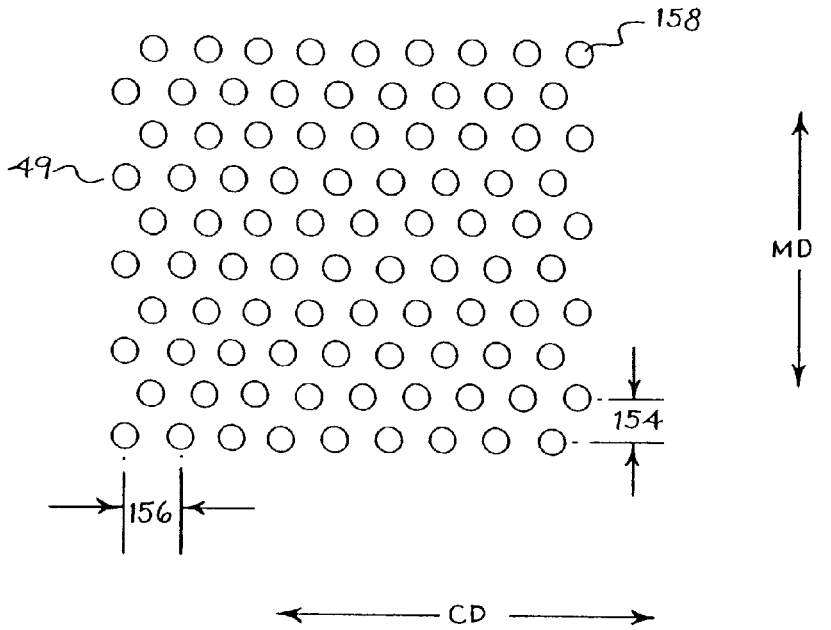
FIG. 14 is a plan view of the surface of a transfer shoe.

Referring to FIG. 14, the curved surface 49 of the transfer shoe may further have a plurality of dimples 158. These dimples may help to channel any excess moisture from the surface of the wet web, or they may help to provide sufficient friction to assist in the formation of the cigarette. The dimples may be cylindrical elements having a diameter of about 1.5 mm and a height of about 1 mm. The tops of the dimples may be rounded, they may be flat, or they may have ridges which can have a height of about 0.05 mm. These dimples may be arrayed as shown in FIG. 14, with rows along the cross direction which have a spacing 154 of 2.5 mm, and a spacing 156 of the dimples within the row of 3.00 mm. Alternate rows may be offset by 1.50 mm. Such a configuration provides for about 85 dimples per square inch. The dimpled surface of the transfer shoe may also be covered with a belt.

The web 42, upper winding roller, and transfer shoe converge to trap a portion of the web between the smooth region of the upper winding roller and the ridge on the transfer shoe. A perforated web will have a line of perforation downstream from this line of convergence, and the distance between the line of perforation and the line of convergence may be from 0 mm to the distance between two adjacent lines of perforation. For a web having 5 inches (127 mm) between lines of perforation, the distance between the line of perforation and the line of convergence may be between 0 mm and 127 mm. The distance between the line of perforation and the line of convergence may be from about 1 mm to about 50 mm, from about 5 mm to about 20 mm, and from about 6 mm to about 13 mm.

Referring to FIG. 13, the convergence of the web, upper winding roller, and transfer shoe serves to reduce the speed of the web at that point, relative to the speed of the web at the perforation. The trapped portion of the web is pinched between the upper winding roller and the transfer shoe ridge, and the web is pulled across the smooth insert. The downstream portion of the web 106 remains anchored to the tungsten carbide surface of the upper winding roller just in front of the smooth insert. The action of pulling the web back or stalling the web on the smooth insert breaks the perforation, forming a leading edge 92 connected to the trapped portion of the web. The ridge on the transfer shoe stays engaged to the upper winding roller, pinning the leading edge until the web contacts the edge of the high surface roughness region. The web is then bunched up between the ridge and the high surface roughness region. This bunched portion then doubles back against the upstream portion of the web 105 and begins to roll into a cigarette 86 due to the differential friction between the rough region and the smooth region. The difference between the surface roughness of the rough region and the surface of the transfer shoe is preferably between 700 Ra and 50 Ra.

The cigarette 86 stays in contact with the upper winding roller, and the rotational movement of the upper winding roller continues to roll the cigarette across the surface of the transfer shoe. The upper winding roller may also move slightly upward (vertically) to allow the cigarette to increase in diameter. The cigarette then moves off the transfer shoe surface and into the gap 152 between the upper winding roller and lower winding roller. Simultaneously, the speed of the lower winding roller is increased from a speed less than the speed of the web to substantially the same speed as the web. The transfer shoe may have fingers that mesh with grooves in the lower winding roller to provide a smooth surface for the cigarette to transition from the shoe to the roller. The growing roll continues to move into the winding pocket 60 until contacted by the rider roller. During the winding of the roll, the lower winding roller and the rider roller rotate at speeds substantially the same as the upper winding roller. The log continues to wind, increasing in size until the proper sheet count and/or diameter is obtained. The rotational speeds of the upper winding roller, the lower winding roller, and the rider roller may be independently varied to control the winding firmness.

It is preferred that the lower winding roller has a tungsten carbide surface. Preferably, the surface of the upper winding roller has a roughness of at least about 300 Ra, more preferably at least about 500 Ra, more preferably still at least about 600 Ra, and more preferably still at least about 700 Ra.

The rider roller is preferably mounted on a movable rider roller arm 94 (FIG. 2). The rider roller arm allows for release of a wound roll 66 from the roll pocket 60 when the rider roller is moved away from the winding rollers. Convergence of the rider roller with the winding rollers forms the roll winding pocket. As a roll nears completion, the rotational motion of the lower winding roller may decrease, and the rotational motion of the rider roller may increase. This speed differential helps to remove the full size roll from the winding pocket. The motion of the rider roller arm may be coordinated with the movement of the transfer shoe such that the release of a wound roll 66 coincides with the separation of the roll 66 from the web 42 and the start of a cigarette 86. Thus, as the full size roll exits the pocket, the web is sandwiched between the transfer shoe ridge and the smooth region of the upper winding roller.

The rotational motion 70 of the wound roll causes the roll to move out of the pocket in the direction of arrow 68 for subsequent delivery or collection. This motion can be assisted by the difference in relative speeds of the upper and lower winding rollers such that the force of the upper roller dominates. The lower winding roller is optionally equipped with a cover or shroud 64 for a portion of the roller that is not part of the roll winding pocket such that the wound roll may rotate onto a stationary surface.

Referring to FIGS. 2 and 11, the wound roll may be delivered from the roll winding pocket or from the shroud over the lower winding roller to a log discharge deck 65. This deck is a substantially flat surface positioned at an angle to allow the roll 66 to roll away from the wet winding apparatus 41. The deck may be planar or curved. Motion of a wound roll is preferably one of rotation 70 such that, at the point of contact between the tail 96 of the roll and a surface, the motion of the tail is opposite the overall motion of the roll itself. This inhibits any unwinding of the roll. The discharge deck may optionally be equipped with a movable dispenser gate 78. This gate can control the delivery of wound rolls to a collection point or to subsequent processing apparatus. The motion of the dispenser gate may be coordinated with the motion of the rider roller arm 94 and/or the transfer shoe 48 such that accumulation of wound rolls 66 at the gate is minimized or eliminated.

Rolls of wound sheet material, whether wet or dry, are prone to exhibit an undesirable loosening of the tail of the roll. For example, the tail 96 of the wet roll 66 as described above can fail to adhere sufficiently to the rest of the wet roll (i.e. the body of the wet roll). Loose tails can cause significant difficulties in subsequent processing of the rolls and in packaging of the final product made from the rolls. For a typical wetting and winding process similar to that described above, up to 20% to 30% of the wet rolls produced have tails which are not adhered to the body of the wet roll. It is desirable that the entire tail portion 96 adheres to the body of the wet roll 66 throughout all subsequent processing and packaging of the roll or of products made from the roll. It is also desirable that the roll maintains its advantageous properties such as the uniform distribution of moisture and other ingredients of the wetting solution.

The adhesion between the body of a wet wound roll and its associated tail portion may be increased to a satisfactory level by applying an adhesion promoter between the tail portion and the body. The adhesion promoter provides for the securing of the tail portion to the body at least for a certain amount of time. A tail that has been secured to the body thus functions as an outer wrapping (or, "outer wrap") for the entire roll, since that portion of the web provides at least a portion of the surface area of the circumference of the roll. It is desirable that the tail is secured to the body throughout any processing and packaging of the roll and of products made from the roll. For example, the adhesion promoter may be applied to either the tail portion or to the body, and the tail portion and body may then be contacted to secure the tail portion to the body. The adhesion promoter may also be applied to both the tail portion and to the body, and it may be applied to the exterior of the entire roll. The adhesion promoter may remain between the outer wrap and the body, or it may disperse throughout the roll over time.

Adhesives and glues are typically used to secure the tail of wound rolls that are not wet. The application of a conventional adhesive to a wet roll, however, can present unique difficulties. For example, the adhesive may be incompatible with the aqueous wetting solution and may fail to bind to the wet web of the roll. The aqueous environment may dilute the adhesive to an ineffective concentration at the tail/body interface. The use of an added adhesive may cause a lack of uniformity of roll composition between the body of the roll and the outer sheets which surround the body.

The adhesion promoter may have a variety of compositions and may be applied in a variety of physical forms. It is desirable for the adhesion promoter to contain water, so as to increase the compatibility of the adhesion promoter with the aqueous environment of the wet roll. It is desirable for less than 10% of the wet rolls produced to have loose tails. More desirably, less than 5% of the wet rolls produced have loose tails; more desirably, less than 3% of the wet rolls produced have loose tails; and, even more desirably, less than 1% of the wet rolls produced have loose tails.

In one example, the adhesion promoter is a supplemental amount of a wetting solution. The wetting solution used as an adhesion promoter may be identical to the wetting solution used to moisten the sheet prior to winding the sheet into a wet roll. The wetting solution used as an adhesion promoter may also have a composition that is different from that used as the sheet-moistening solution. For example, the concentration of the various ingredients, such as salts; skin-care additives; odor control agents; detackifying agents; particulates; antimicrobial agents; preservatives; wetting agents and cleaning agents including detergents, surfactants, and some silicones; emollients; surface feel modifiers; fragrance; fragrance solubilizers; opacifiers; fluorescent whitening agents; UV absorbers; pharmaceuticals; and pH control agents, may be higher or lower in the adhesion promoter composition.

Figure 16:
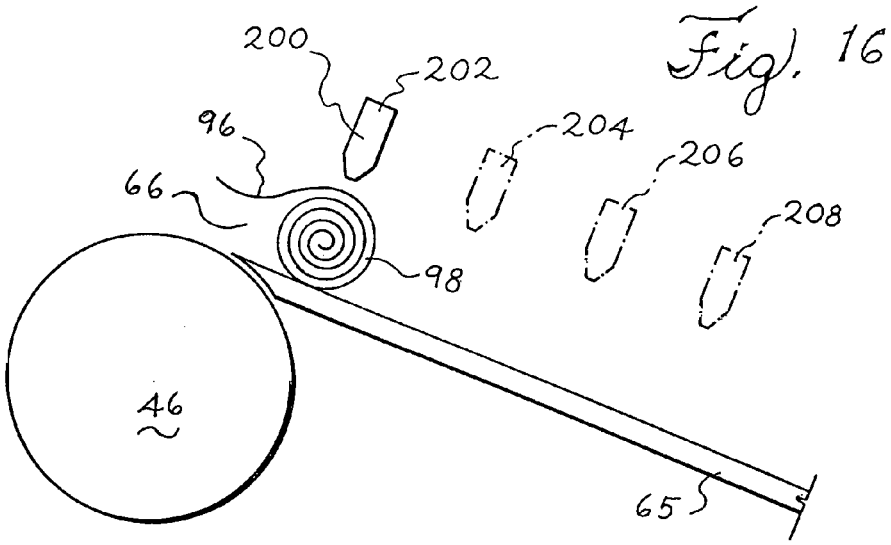
FIG. 16 is a diagram of an adhesion promoter application.

The supplemental wetting solution may be applied between the tail and the body by way of a solution applicator such as a spray boom or a drool bar positioned downstream of the roll winding pocket. Referring to FIG. 16, the solution applicator 200 may be positioned at various points 202, 204, 206, or 208 along the discharge deck 65. FIG. 16, also illustrates the roll 66 having a tail 96 and body 98. The supplemental wetting solution can soak into the tail and the roll, increasing the overall solution add-on. For example, for a wet roll having a solution add-on of 240% upon completion of the winding process, the application of supplemental wetting solution can increase the overall add-on to 250%. In applying a supplemental wetting solution in liquid form, it is desirable that the overall add-on is between about 240% and 300%, or desirably between about 245% and 275%, or desirably about 250%.

The supplemental wetting solution may be applied as a foam. The composition of a supplemental wetting solution used to form a foam may be the same as or may be different from the composition of the wetting solution used before winding to moisten the web. The wetting solutions, such as those described herein and in the copending applications listed above, contain at least one surfactant. Foams of these wetting solutions can thus be prepared by forcing a gas through the wetting solution containing a surfactant. For example, a high pressure spray nozzle may be used to generate foam from a wetting solution as the solution passes through the tip of the nozzle.

It may be desirable to form a foam with a wetting solution which is identical to the wetting solution used to moisten the web, in order to reduce the complexity in manufacturing and to ensure the even distribution of ingredients within the roll. The composition of a supplemental wetting solution used for the foam may, however, be modified to provide for optimum foam formation and adhesion promotion for a particular set of processing conditions. Changes in the chemical structure of the surfactant, changes in the concentration of the surfactant, and the use of combinations of different surfactants can all contribute to the optimization of the foaming solution. For example, the surfactant used may be an anionic surfactant, a cationic surfactant, a nonionic surfactant, an amphoteric surfactant, or mixtures of these.

A wide variety of surfactants may be used. Non-ionic surfactants include for example, the condensation products of ethylene oxide with a hydrophobic (oleophilic) polyoxyalkylene base formed by the condensation of propylene oxide with propylene glycol, for example pluronic surfactants (BASF Wyandotte Corp.), such as Pluronic L-62. Other useful nonionic surfactants include for example, the condensation products of $C_8$–$C_{22}$ alkyl alcohols with 2–50 moles of ethylene oxide per mole of alcohol. Examples of compounds of this type include the condensation products of $C_{11}$–$C_{15}$ secondary alkyl alcohols with 3–50 moles of ethylene oxide per mole of alcohol, which are commercially-available as the Poly-Tergent SLF series from Olin Chemicals or the TERGITOL® series from Union Carbide, i.e. TERGITOL® 25-L-7. Other nonionic surfactants include the ethylene oxide esters of $C_6$–$C_{12}$ alkyl phenols such as (nonylphenoxy)polyoxyethylene ether, for example the IGEPAL® CO series (GAF Corp.). Further non-ionic surface active agents include for example, alkyl polyglycosides (APG), derived as a condensation product of dextrose (D-glucose) and a straight or branched chain alcohol, such as those available from Horizon Chemical under the trade names of APG-300, APG-350, APG-500, and APG-500. Silicones are another class of wetting agents available in pure form, or as microemulsions, macroemulsions, and the like. One exemplary non-ionic surfactant group is the silicone-glycol copolymers, available from the Dow Corning Corp as Dow Corning 190 and 193 surfactants (CTFA name: dimethicone copolyol).

Anionic surfactants may also be used, including anionic detergent salts having alkyl substituents of 8 to 22 carbon atoms such as the water-soluble higher fatty acid alkali metal soaps, e.g., sodium myristate and sodium palmitate; and water-soluble sulfated and sulfonated anionic alkali metal and alkaline earth metal detergent salts containing a hydrophobic higher alkyl moiety (typically containing from about 8 to 22 carbon atoms) such as salts of higher alkyl mono or polynuclear aryl sulfonates having from about 1 to 16 carbon atoms in the alkyl group, with examples available as the Bio-Soft series, i.e. Bio-Soft D-40 (Stepan Chemical Co.). Other useful classes of anionic surfactants include for example, the alkali metal salts of alkyl naphthalene sulfonic acids (methyl naphthalene sodium sulfonate, Petro AA, Petrochemical Corporation); sulfated higher fatty acid monoglycerides such as the sodium salt of the sulfated monoglyceride of cocoa oil fatty acids and the potassium salt of the sulfated monoglyceride of tallow fatty acids; alkali metal salts of sulfated fatty alcohols containing from about 10 to 18 carbon atoms (e.g., sodium lauryl sulfate and sodium stearyl sulfate); sodium $C_{14}$–$C_{16}$-alphaolefin sulfonates such as the Bio-Terge series (Stepan Chemical Co.); alkali metal salts of sulfated ethyleneoxy fatty alcohols (the sodium or ammonium sulfates of the condensation products of about 3 moles of ethylene oxide with a $C_{12}$–$C_{15}$ n-alkanol, i.e., the Neodol ethoxysulfates, Shell Chemical Co.); alkali metal salts of higher fatty esters of low molecular weight alkylol sulfonic acids, e.g. fatty acid esters of the sodium salt of isothionic acid, the fatty ethanolamide sulfates; the fatty acid amides of amino alkyl sulfonic acids, e.g. lauric acid amide of taurine; as well as numerous other anionic organic surface active agents such as sodium xylene sulfonate, sodium naphthalene sulfonate, sodium toulene sulfonate and mixtures thereof. Other useful anionic surfactants include sodium cocoyl glutamate, TEA cocoyl glutamate, and sodium cocoyl sarcosinate. A further useful class of anionic surfactants includes the 8-(4-n-alkyl-2-cyclohexenyl)-octanoic acids, wherein the cyclohexenyl ring is substituted with an additional carboxylic acid group. These compounds or their potassium salts, are commercially-available from Westvaco Corporation as Diacid 1550 or H-240. In general, these anionic surface active agents can be employed in the form of their alkali metal salts, ammonium or alkaline earth metal salts.

Measurable properties of foams include foamability and foam stability, as defined and standardized by ASTM Method D 1173—Foaming Properties of Surface-Active Agents. Foamability is the initial height of the foam at a given concentration of surfactant. The foamability of a supplemental wetting solution is desirably from about 1 cm to about 4 cm, desirably from about 1.5 cm to about 3 cm, or desirably about 2 cm. Foam stability is the height of the foam at a given concentration of surfactant at a particular period of time after foam formation. The desirable foam stability of a supplemental wetting solution is dependent on the time necessary for the processing of the wet roll and the packaging of the wet rolled product. As the time required for processing and packaging increases, the desired minimum foam stability will also increase. Changes in the composition of the supplemental wetting solution can also result in changes in the density of the foam or to the size range of the bubbles in the foam.

Figure 17:
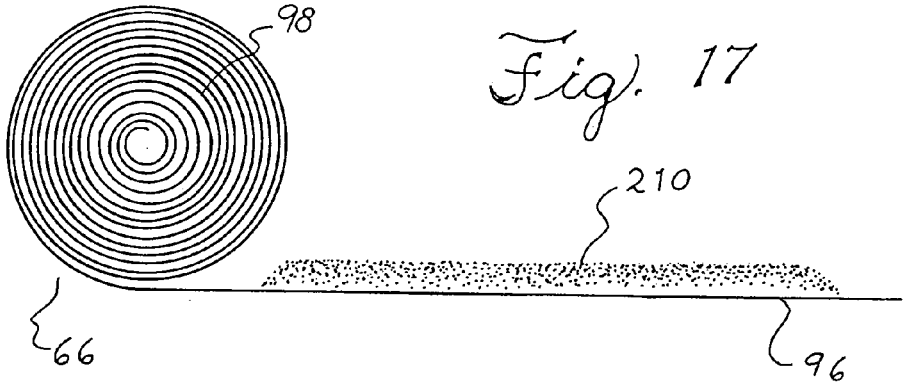
FIGS. 17 and 18 are views of configurations of adhesion promoter applications.
Figure 18:
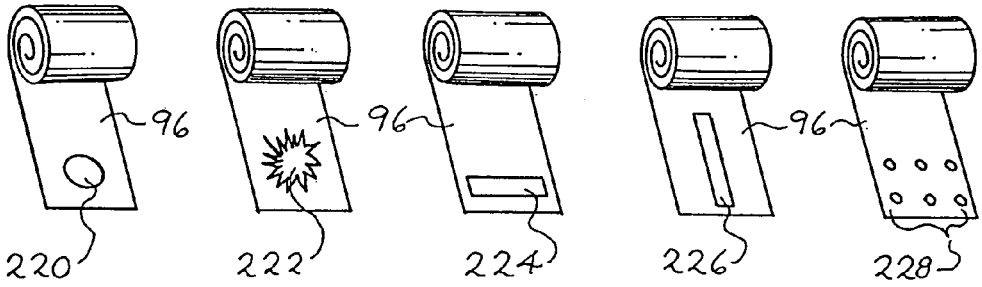

An adhesion promoter containing foamed supplemental wetting solution can be applied to the body and tail by a variety of methods. For example, foam 210 can be deposited on the tail portion 96 as illustrated in FIG. 17. Referring to FIG. 18, foam can be applied to the tail portion in particular configurations 220, 222, 224, 226, and 228. Foam can be applied to an entire wet wound roll before further processing by depositing numerous portions of foam in any of these or other configurations on the tail portion along the axis of the roll.

Figure 19:
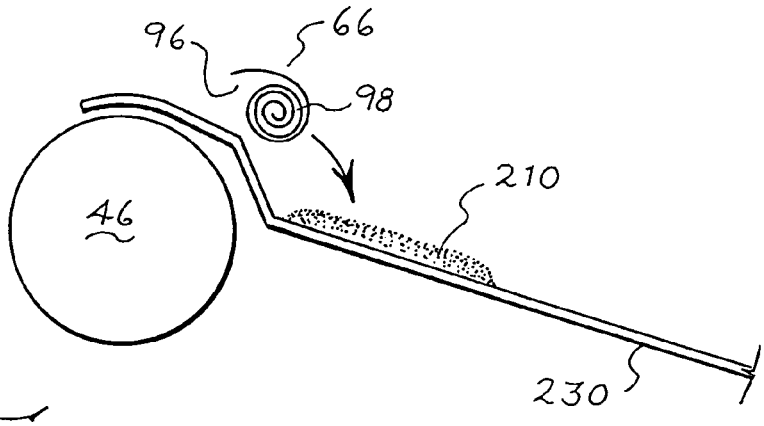
FIG. 19 is a diagram of a foam application.

Foamed supplemental wetting solution may also be applied to the web prior to winding, and may be applied together with the solution application. Foamed supplemental wetting solution may be applied to the entire wet wound roll after completion of the winding process. The application of foamed adhesion promoter to the wet wound roll may be combined with the application of supplemental wetting solution in liquid form. The foam may be deposited onto the body and the tail. For example, the spray nozzle producing the foam may be configured to spray the foam onto specific areas of the tail or of the body. The foam may be applied to a surface onto which the tail and body are deposited. Referring to FIG. 19, foamed supplemental wetting solution 210 may be applied to a discharge deck 230. When a wet wound roll 66 exits the wet winder, it will fall or roll into the foam and will then rotate out of the foam as it continues along the discharge deck. This configuration provides for application of the adhesion promoter between the tail 96 of the roll and the body 98 of the roll.

Without wishing to be bound by any theory of interpretation, it is believed that the foam can reside on the surface of the web for longer periods of time than can a solution in liquid form. This longer residence time on the web surface may be due to the effective viscosity of the foam, which is greater than the viscosity of the liquid. Since the foam resides longer on the web surface, the increased surface tension due to the presence of the aqueous mixture at the interface of the tail and the body may thus be maintained for longer periods of time. It is believed that the observed increase in adhesion when a foam is applied as an adhesion promoter may be due to the longer lasting increased surface tension.

In another example, the adhesion promoter may contain an adhesive. It is desirable that any adhesive used is compatible with an aqueous environment. For example, the adhesive may be soluble in water. The adhesive may be dispersible in water, for example as observed for emulsion-based adhesives. For example, the adhesion promoter may include a pressure sensitive adhesive or a heat sensitive adhesive. Specific examples of adhesives which may be used in an adhesion promoter include poly(vinyl alcohol), poly(vinyl acetate), poly(acrylic acid), and mixtures and copolymers thereof, and cellulose derivatives such as cellulose ethers, hydroxyalkyl cellulose and carboxyalkyl cellulose. Adhesion promoters containing an adhesive can be applied as an aqueous liquid by way of a solution applicator, or can be applied as an aqueous foam, using the application techniques described above.

In another example, a viscous aqueous composition can also be used as an adhesion promoter. A viscous aqueous composition may be applied by depositing the composition at particular points on the tail, as illustrated in FIG. 18. The aqueous composition can gradually absorb and diffuse into the rest of the roll, but the increased adhesion can be made to last long enough for the processing of the wet roll and the packaging of products made from the roll. Viscous compositions may contain concentrated aqueous mixtures of surfactants. Viscous compositions may contain water soluble or water dispersible adhesives and/or polymers. Desirably, the viscosity of a viscous aqueous composition for use as an adhesion promoter is at least 100 centipoise (cps). It may be desirable for a viscous aqueous composition to have a viscosity of at least 150 cps, or more desirably at least 200 cps. The viscosity of an adhesion promoter composition can be manipulated by varying parameters such as polymer or adhesive content, salt concentration, and the size and chemical structure of surfactant molecules.

Once an adhesion promoter has been applied to the tail and the body, the roll can be transported away from the application site. The roll that has been subjected to an application of adhesion promoter is thus referred to as a "treated roll." Referring again to FIG. 11, the rotation of the roll on the discharge deck causes the tail to repeatedly contact the body of the roll as the roll moves away from the winding apparatus. In this case, the application site is a part of the discharge deck, and the treated roll is transported from the application site by allowing the treated roll to rotate along the discharge deck.

Figure 20:
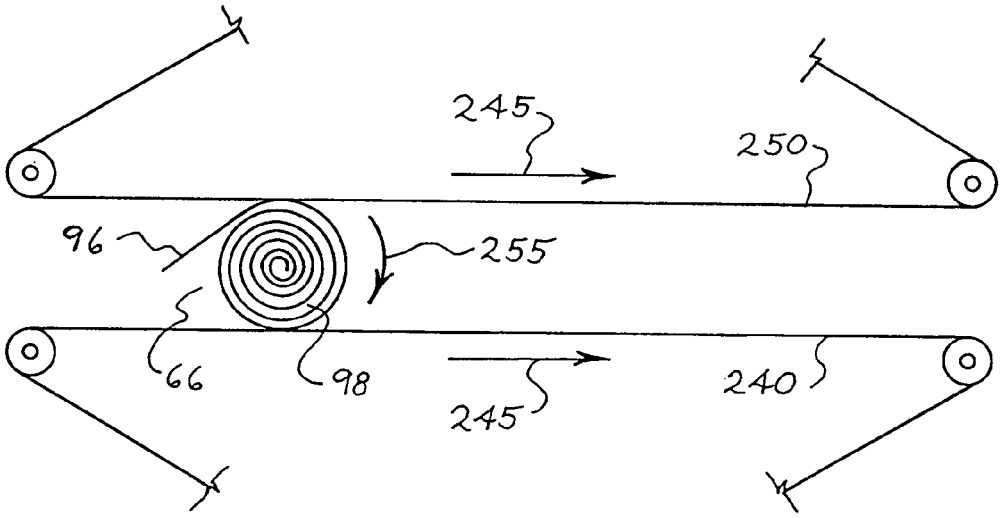
FIG. 20 is a diagrammatic view of conveyor bets.

It may be desirable to increase the amount of contact between the tail and the roll by providing an applied force to the tail and roll. For example, after an adhesion promoter has been applied to the body of a roll and/or the tail, the roll can be transported away from the application site by a conveyor system having a lower conveyor belt and an upper conveyor belt. Referring to FIG. 20, the lower conveyor belt 240 and the upper conveyor belt 250 are configured to contact both the top and the bottom of the roll 66. The conveyor belts move in the direction of arrow 245, with the upper belt moving at a higher speed than the lower belt. Thus, the overall motion of the roll is also in the direction of arrow 245, and the roll is rotated in the direction of arrow 255. Such a conveyor system provides for contact of the tail 96 to the body 98 of the roll at both the top and bottom of the roll, aiding in the wrapping of the tail around the roll.

It is preferred that the equipment used for the wetting and winding of wet rolls, as well as for securing the tails of wet rolls to the wet roll body, are resistant to corrosion. The apparatus and their components may also be coated with corrosion resistant materials. Examples of corrosion resistant materials include 316L stainless steel, nickel and its alloys, tungsten carbide, and poly(tetrafluoroethylene) (TEFLON, DUPONT). The components of the apparatus may be controlled by standard controlling equipment and software. For example, the apparatus may be controlled and monitored with a standard programmable logic controller (PLC). Individual apparatus may have separately controls, and these controls may be operably linked with the main control for the overall apparatus. For example, the winding apparatus and the application of adhesion promoter may be controlled and monitored with a PanelMate Human Machine Interface (HMI). The HMI can control the starting, stopping, dispensing, and other parameters that affect the wetting and winding of the web and the securing of the tails of the wet rolls. The HMI may interface to the PLC (Programmable Logic Controller) that actually controls the machine.

Aside from the processing and production efficiency advantages due to increased tail adhesion, additional advantages include the lack of observable residue in the final wet rolled product. For example, if the final product is an individual roll of wet wipes, residual adhesion material or residual markings could have a negative impact on consumer acceptance and satisfaction. The adhesion promoters as described can be dispersed through the wet roll over time, due to the compatibility of the aqueous compositions with the aqueous environment of the roll. This is especially apparent for adhesion promoters containing a supplemental wetting solution having the same composition as the initial solution used to wet the web. Excess moisture in the outer wrap of the roll can be absorbed by the body of the roll over time. A foamed structure will tend to break down over time, so that no observable foam remains by the time a consumer can use the product. Another advantage of the foamed adhesion promoter is the minimal amount of additional wetting solution add-on that can be used. Very small amounts of liquid can provide the desired increase in adhesion when applied as a foam having a large surface area. Due to the dispersion of the ingredients of the adhesion promoter, the increased strength of the tail adhesion will tend to be reduced over time. A lower tail adhesion, which is closer to the peel strength of the overall roll of wet wipes, can allow a consumer to locate the tail of the roll more readily, providing for easier use of the wipes.

The invention claimed is:

1. An apparatus for making wet rolls, comprising:

means for dispensing a first wetting solution onto a web of sheet material to form a wet web of sheet material;

means for winding the wet web of sheet material into a wet roll of wound sheet material, the wet roll comprising a body and a tail pendant to the body, wherein the means for winding the wet web of sheet material is downstream of the means for dispensing the first wetting solution;

means for applying a second wetting solution comprising an adhesion promoter to the wet roll, wherein the means for applying the second wetting solution is downstream of the means for winding the wet web of sheet material; and means for contacting the tail to the body.

2. The apparatus of claim 1, wherein the means for dispensing the first wetting solution comprises means for adding on greater than about 25% weight percent liquid based on the dry weight of the roll of wet wound sheet material.

3. The apparatus of claim 1, wherein the means for applying an adhesion promoter comprises means for forming an aqueous foam.

4. The apparatus of claim 3, wherein the means for applying an adhesion promoter further comprises means for depositing the roll onto the foam, wherein the foam is on a surface.

5. The apparatus of claim 1, wherein the means for contacting the tail to the body comprises means for rotating the body onto the tail.

6. The apparatus of claim 1, wherein the means for contacting the tail to the body comprises means for pressing the tail to the body.

7. The apparatus of claim 1, further comprising a means for breaking the wet web of sheet material, wherein the means for breaking the wet web of sheet material is upstream from the means for applying the second wetting solution.

8. The apparatus of claim 1, wherein the means for dispensing the first wetting solution comprises means for adding on from about 200 to about 400 weight percent liquid based on the dry weight of the roll of wet wound sheet material.

9. The apparatus of claim 1, wherein the means for dispensing the first wetting solution onto the web of sheet material comprises means for uniformly applying the first wetting solution throughout the entire web of sheet material.

10. The apparatus of claim 1, wherein the means for dispensing the first wetting solution onto the web of sheet material comprises a means for applying pressure when applying the first wetting composition to the web of sheet material.

11. The apparatus of claim 1, wherein the means for applying the second wetting solution comprises means for dispensing an aqueous foam onto the wet roll.

12. The apparatus of claim 1, wherein the means for contacting the tail to the body comprises providing a foam on a surface, and allowing the roll to pass through the foam on the surface.

13. The apparatus of claim 1, wherein the apparatus comprises means for producing uniformly wet rolls, wherein less than 10% of the uniformly wet rolls produced have loose tails.

14. The apparatus of claim 1, wherein the apparatus comprises means for producing uniformly wet rolls, wherein less than 3% of the uniformly wet rolls produced have loose tails.

15. An apparatus for making wet rolls, comprising:

a wetting apparatus that dispenses a first wetting solution throughout a web of sheet material to form a wet web;

a wet winding apparatus downstream from the wetting apparatus to wind the wet web of sheet material into a wet roll of wound sheet material comprising a body and a tail pendant to the body;

a surface positioned to accept the wet roll; and a solution applicator downstream from the wet winding apparatus that dispenses a second wetting solution comprising an adhesion promoter onto the wet roll once the wet roll is on the surface.

16. The apparatus of claim 15, wherein the surface comprises an inclined plane such that the body can rotate onto the tail along the plane.

17. The apparatus of claim 15, wherein the solution applicator comprises a spray nozzle, and the second wetting solution is in the form of a foam.

18. The apparatus of claim 17, wherein the foam is dispensed from the solution applicator onto a portion of the surface, and the surface is positioned such that the roll contacts the foam on said portion of the surface.

19. The apparatus of claim 17, wherein the solution applicator is configured to apply the foam to the entire wet wound roll after completion of the winding process.

20. The apparatus of claim 17, wherein the solution applicator is configured to apply the foam to the body and the tail.

21. The apparatus of claim 17, wherein the solution applicator is configured to apply the foam onto the tail.

22. The apparatus of claim 17, wherein the solution applicator is configured to apply the foam an exterior of the roll.

23. The apparatus of claim 17, wherein the contacting comprises providing the foam on a surface, and allowing the roll to pass through the foam on the surface.

24. The apparatus of claim 17, wherein the contacting comprises allowing the body to rotate onto the tail.

25. The apparatus of claim 17, wherein the contacting comprises pressing the tail to the body.

26. The apparatus of claim 17, wherein the pressing comprises rotating the roll between an upper conveyor belt and a lower conveyor belt.

27. The apparatus of claim 15, wherein the solution applicator comprises a drool bar.

28. The apparatus of claim 15, wherein the solution applicator comprises a spray boom.

29. The apparatus of claim 15, wherein the wetting apparatus is configured to dispense the first wetting solution throughout the roll of wet wound sheet material with an add-on of greater than about 25 weight percent liquid based on the dry weight of the roll of wet wound sheet material.

30. The apparatus of claim 15, wherein the wetting apparatus is configured to dispense the first wetting solution throughout the roll of wet wound sheet material with an add-on of from about 200 about 400 weight percent liquid based on the dry weight of the roll of wet wound sheet material.

31. The apparatus of claim 15, wherein the wetting apparatus is configured to uniformly dispense the first wetting solution throughout the entire roll of sheet material.

32. The apparatus of claim 15, wherein the wetting apparatus for dispensing the first wetting solution comprises a fluid distribution header.

33. The apparatus of claim 15, wherein the wetting apparatus for dispensing the first wetting solution comprises a drool bar.

34. The apparatus of claim 15, wherein the wetting apparatus for dispensing the first wetting solution comprises a spray boom.

35. The apparatus of claim 15, further comprising press rolls applying pressure to force the first wetting solution into the roll of sheet material.

36. The apparatus of claim 35, wherein the pressure is controllable and wherein the press rolls can be adjusted to modify the rate at which the first wetting solution is absorbed.

37. The apparatus of claim 15, wherein the second wetting solution is the same as the first wetting solution.

38. The apparatus of claim 15, wherein the second wetting solution comprises an adhesive.

39. The apparatus of claim 38, wherein the adhesive comprises an emulsion.

40. The apparatus of claim 15, wherein the second wetting solution comprises a viscous aqueous composition.

41. The apparatus of claim 40, wherein the viscous aqueous composition has a viscosity of at least about 100 centipoise.

42. The apparatus of claim 40, wherein the viscous aqueous composition comprises a surfactant or an adhesive.

43. The apparatus of claim 15, wherein the apparatus is capable of producing uniformly wet rolls, wherein less than 10% of the uniformly wet rolls produced have loose tails.

44. The apparatus of claim 15, wherein the apparatus comprises means for producing uniformly wet rolls, wherein less than 3% of the uniformly wet rolls produced have loose tails.

45. The apparatus of claim 15, wherein the wet winding apparatus comprises means for breaking the wet web of sheet material.

* * * * *